US010124205B2

(12) United States Patent
Matsuura et al.

(10) Patent No.: US 10,124,205 B2
(45) Date of Patent: Nov. 13, 2018

(54) TONING GARMENT WITH MODULAR RESISTANCE UNIT DOCKING PLATFORMS

(71) Applicant: Tau Orthopedics, LLC, Coto de Caza, CA (US)

(72) Inventors: Belinko K. Matsuura, Solana Beach, CA (US); David G. Matsuura, Solana Beach, CA (US); Gerard von Hoffmann, Coto de Caza, CA (US)

(73) Assignee: Tau Orthopedics, LLC, Rancho Santa Fe, CA (US)

( * ) Notice: Subject to any disclaimer, the term of this patent is extended or adjusted under 35 U.S.C. 154(b) by 55 days.

(21) Appl. No.: 15/069,053

(22) Filed: Mar. 14, 2016

(65) Prior Publication Data

US 2017/0259102 A1 Sep. 14, 2017

(51) Int. Cl.

| | |
|---|---|
| ***A63B 21/02*** | (2006.01) |
| ***A63B 21/04*** | (2006.01) |
| ***A63B 21/045*** | (2006.01) |
| ***A63B 21/055*** | (2006.01) |
| ***A63B 21/00*** | (2006.01) |
| ***A63B 21/008*** | (2006.01) |
| *A41D 13/00* | (2006.01) |

(52) U.S. Cl.

CPC ..... *A63B 21/0414* (2013.01); *A63B 21/008* (2013.01); *A63B 21/045* (2013.01); *A63B 21/0557* (2013.01); *A63B 21/4009* (2015.10); *A63B 21/4011* (2015.10); *A41D 13/0015* (2013.01); *A63B 21/00061* (2013.01)

(58) Field of Classification Search

CPC ..... A63B 21/04; A63B 21/40; A63B 21/05; A41D 13/0015; A41D 1/08

See application file for complete search history.

(56) References Cited

U.S. PATENT DOCUMENTS

| | | | | |
|---|---|---|---|---|
| 2,664,566 A | | 1/1954 | Mianulli | |
| 2,832,334 A | * | 4/1958 | Whitelaw | A63B 23/14 482/118 |
| 4,065,814 A | | 1/1978 | Fox | |

(Continued)

FOREIGN PATENT DOCUMENTS

WO WO 2014/194257 12/2014

OTHER PUBLICATIONS

U.S. Appl. No. 12/951,947 (U.S. Pat. No. 8,986,177), filed Nov. 22, 2010, Low Profile Passive Exercise Garment.

(Continued)

*Primary Examiner* — Loan H Thanh
*Assistant Examiner* — Garrett Atkinson
(74) *Attorney, Agent, or Firm* — Knobbe, Martens, Olson & Bear, LLP

(57) ABSTRACT

Disclosed is a muscle toning garment configured for use with modular, interchangeable resistance elements. The garment provides resistance to movement throughout an angular range of motion. The garment may be low profile, and worn by a wearer as a primary garment or beneath conventional clothing. Toning may thereby be accomplished throughout the wearer's normal daily activities, without the need for access to conventional exercise equipment. Alternatively, the device may be worn as a supplemental training tool during conventional training techniques.

26 Claims, 20 Drawing Sheets

(56) References Cited

U.S. PATENT DOCUMENTS 4,180,261 A * 12/1979 Kolka ..... A63B 21/065 2/22
4,485,808 A * 12/1984 Hepburn ..... A61F 5/0102 602/5
4,621,620 A 11/1986 Anderson
4,657,000 A * 4/1987 Hepburn ..... A61F 5/0102 602/16
4,829,989 A 5/1989 Deamer et al.
4,875,677 A 10/1989 Tetreault
4,910,802 A 3/1990 Malloy
4,947,835 A 8/1990 Hepburn et al.
5,052,379 A * 10/1991 Airy ..... A61F 5/0125 482/112
5,176,600 A 1/1993 Wilkinson
5,201,074 A 4/1993 Dicker
5,263,923 A 11/1993 Fujimoto
5,282,460 A 2/1994 Boldt
5,306,222 A 4/1994 Wilkinson
5,308,305 A 5/1994 Romney
5,337,737 A 8/1994 Rubin et al.
5,399,154 A 3/1995 Kipnis et al.
5,465,428 A 11/1995 Earl
5,472,412 A * 12/1995 Knoth ..... A61F 5/0123 428/111
5,527,244 A 6/1996 Waller et al.
5,553,322 A 9/1996 Cebo-Johnson
5,662,595 A 9/1997 Chesher et al.
5,685,811 A 11/1997 McShane et al.
5,720,042 A 2/1998 Wilkinson
5,749,840 A * 5/1998 Mitchell ..... A61F 5/0123 602/23
5,788,618 A * 8/1998 Joutras ..... A43B 1/0054 482/114
5,792,034 A 8/1998 Kozlovsky
RE35,940 E 10/1998 Heinz et al.
5,842,959 A 12/1998 Wilkinson
5,857,947 A 1/1999 Dicker et al.
5,867,827 A 2/1999 Wilkinson
5,875,491 A 3/1999 Wilkinson
5,937,441 A 8/1999 Raines
5,960,474 A 10/1999 Dicker et al.
5,976,063 A 11/1999 Joutras et al.
5,978,966 A * 11/1999 Dicker ..... A41D 13/0015 2/115
5,993,362 A * 11/1999 Ghobadi ..... A63B 21/0004 482/121
6,039,677 A * 3/2000 Spletzer ..... A63B 21/0605 2/22
6,129,638 A * 10/2000 Davis ..... A63B 69/0059 473/215
6,176,816 B1 * 1/2001 Dicker ..... A63B 21/00185 2/69.5
6,186,970 B1 2/2001 Fujii et al.
6,210,354 B1 4/2001 Ousdal
6,231,488 B1 5/2001 Dicker et al.
6,314,580 B1 11/2001 Greenberg et al.
6,356,847 B1 3/2002 Gerlitzki
6,397,496 B1 6/2002 Seymour
6,409,693 B1 6/2002 Brannigan
6,418,797 B1 7/2002 Ambrosina et al.
6,430,752 B1 8/2002 Bay
6,440,094 B1 8/2002 Maas
6,656,097 B2 12/2003 Karecki
6,666,801 B1 12/2003 Michalow
6,757,916 B2 7/2004 Mah et al.
6,769,134 B1 * 8/2004 Mendez ..... A41D 13/065 2/22
6,834,752 B2 12/2004 Irby et al.
6,872,187 B1 3/2005 Stark et al.
6,954,968 B1 10/2005 Sitbon
7,048,098 B1 5/2006 Moradian
7,087,003 B1 8/2006 Katterjohn
7,153,246 B2 12/2006 Koscielny et al.
7,235,038 B2 6/2007 Liao
7,278,954 B2 10/2007 Kawai et al.
7,431,707 B2 10/2008 Ikeuchi
7,599,806 B2 10/2009 Hauschildt
7,608,026 B1 10/2009 Nicassio
7,659,636 B2 2/2010 Donelan et al.
7,682,322 B2 3/2010 Engelman
7,744,511 B2 6/2010 Gregoriev
7,758,481 B2 7/2010 Drennan
7,777,879 B2 8/2010 Baxter et al.
7,845,023 B2 12/2010 Swatee
7,849,518 B2 12/2010 Moore et al.
7,857,774 B2 12/2010 Sankai
7,860,607 B2 12/2010 Kawai et al.
7,861,319 B2 * 1/2011 Torry ..... A41D 1/08 2/69
7,874,970 B2 1/2011 Glisan
7,931,571 B2 4/2011 Bernardoni
7,947,004 B2 5/2011 Kazerooni et al.
8,043,243 B2 10/2011 Nathanson
8,052,379 B2 11/2011 Gammack
8,060,945 B2 * 11/2011 Adarraga ..... A61F 5/0102 2/22
8,063,644 B2 11/2011 Rezvani et al.
8,096,965 B2 1/2012 Goffer et al.
8,171,570 B2 5/2012 Adarraga
8,273,001 B2 9/2012 Karecki et al.
8,312,646 B2 11/2012 Meschter et al.
8,409,117 B2 4/2013 Cheng et al.
8,454,637 B2 6/2013 Aggerholm et al.
8,544,114 B2 * 10/2013 Williams ..... A41D 13/0015 2/227
8,555,415 B2 10/2013 Bradstreet et al.
8,663,133 B2 3/2014 Johnson et al.
8,762,077 B2 6/2014 Redmond et al.
8,864,846 B2 10/2014 Herr et al.
8,951,136 B1 2/2015 Booher
8,986,177 B2 3/2015 von Hoffmann et al.
9,046,387 B2 6/2015 Wong et al.
9,192,806 B2 11/2015 Mial
9,198,821 B2 12/2015 Unluhisarcikli et al.
9,204,811 B2 12/2015 Wright
9,216,131 B2 12/2015 Nakashima et al.
9,221,177 B2 12/2015 Herr et al.
9,327,156 B2 5/2016 von Hoffmann et al.
9,333,097 B2 5/2016 Herr et al.
9,333,644 B2 5/2016 Angold
9,339,396 B2 5/2016 Wilkinson
9,351,900 B2 5/2016 Walsh et al.
9,375,603 B2 6/2016 Matsuura et al.
9,409,053 B1 8/2016 Todd
9,433,814 B2 9/2016 von Hoffmann
9,445,931 B2 9/2016 Imaida et al.
9,498,401 B2 11/2016 Herr et al.
9,656,117 B2 5/2017 von Hoffmann et al.
9,770,617 B2 9/2017 von Hoffmann et al.
2001/0029224 A1 10/2001 Karecki
2004/0040064 A1 3/2004 Mah et al.
2004/0116260 A1 6/2004 Drennan
2005/0101887 A1 5/2005 Stark et al.
2005/0148915 A1 7/2005 Nathanson et al.
2005/0239602 A1 10/2005 Cordova et al.
2005/0255975 A1 11/2005 Horn
2005/0261113 A1 11/2005 Wilkinson
2005/0275416 A1 12/2005 Hervieux et al.
2006/0000478 A1 1/2006 Taylor
2006/0016649 A1 1/2006 Gordaninejad et al.
2006/0046910 A1 3/2006 Rastegar et al.
2006/0046913 A1 3/2006 Squittieri
2006/0079825 A1 4/2006 Hilton et al.
2006/0096818 A1 5/2006 Moradian
2006/0272071 A1 12/2006 Mickle
2006/0287621 A1 12/2006 Atkinson et al.
2007/0010772 A1 * 1/2007 Ryan ..... A61F 5/0123 602/26
2007/0016120 A1 1/2007 Latronica et al.
2007/0032359 A1 2/2007 Toronto
2007/0100265 A1 * 5/2007 Gamada ..... A61F 5/0123 602/16
2007/0123997 A1 5/2007 Herr et al.

(56) References Cited

U.S. PATENT DOCUMENTS

2007/0135279 A1* 6/2007 Purdy ..... A63B 21/0004 482/124
2007/0219074 A1 9/2007 Pride
2007/0245835 A1 10/2007 Hauschildt
2008/0009771 A1 1/2008 Perry et al.
2008/0026917 A1 1/2008 Campana
2008/0108918 A1* 5/2008 Joutras ..... A61H 1/02 601/34
2008/0218310 A1 9/2008 Alten et al.
2009/0253325 A1 10/2009 Brookstein et al.
2009/0281394 A1 11/2009 Russell et al.
2010/0041527 A1 2/2010 Miller
2010/0075557 A1 3/2010 Shteiyer
2010/0077527 A1 4/2010 Lee et al.
2010/0144490 A1 6/2010 Purdy et al.
2010/0193304 A1 8/2010 Böse et al.
2010/0223717 A1 9/2010 Foy et al.
2010/0248915 A1 9/2010 Gibson-Horn
2010/0267525 A1 10/2010 Tanner
2010/0323859 A1* 12/2010 von Hoffmann ..... A63B 23/03508 482/124
2011/0010001 A1 1/2011 Chung et al.
2011/0040216 A1 2/2011 Herr et al.
2011/0111932 A1 5/2011 von Hoffmann et al.
2011/0126335 A1 6/2011 Schultz
2011/0224585 A1 9/2011 Hall
2011/0231986 A1 9/2011 Waldie et al.
2011/0247127 A1 10/2011 Pou
2011/0266323 A1 11/2011 Kazerooni et al.
2011/0314590 A1 12/2011 Perron et al.
2012/0094811 A1 4/2012 Karecki
2012/0116258 A1 5/2012 Lee
2012/0136231 A1 5/2012 Markel
2012/0225755 A1 9/2012 Lloyd
2013/0085040 A1 4/2013 Bowers
2013/0130874 A1 5/2013 Richardson et al.
2013/0150218 A1 6/2013 Mial
2013/0190147 A1 7/2013 Luo et al.
2013/0198625 A1 8/2013 Anderson et al.
2013/0207889 A1 8/2013 Chang et al.
2013/0247330 A1 9/2013 Daul et al.
2013/0260968 A1 10/2013 Shkolnik
2013/0298301 A1 11/2013 Petrakis et al.
2013/0338472 A1 12/2013 Macia Barber et al.
2014/0068973 A1 3/2014 Krupenkin et al.
2014/0100493 A1 4/2014 Craig et al.
2014/0109282 A1 4/2014 White et al.
2014/0135593 A1 5/2014 Jayalth et al.
2014/0173934 A1 6/2014 Bell
2014/0200121 A1 7/2014 von Hoffmann et al.
2014/0207030 A1 7/2014 Hall
2014/0222943 A1 8/2014 Oleson et al.
2014/0238153 A1 8/2014 Wood et al.
2014/0265677 A1 9/2014 Orand
2014/0278125 A1 9/2014 Balakrishnan et al.
2014/0278229 A1 9/2014 Hong et al.
2014/0296761 A1 10/2014 Yamamoto et al.
2014/0303538 A1 10/2014 Baym et al.
2014/0313049 A1 10/2014 Doherty
2014/0336020 A1 11/2014 von Hoffmann et al.
2014/0358053 A1 12/2014 Triolo et al.
2014/0358193 A1 12/2014 Lyons et al.
2014/0358473 A1 12/2014 Manan et al.
2014/0364771 A1 12/2014 Pitts et al.
2014/0379275 A1 12/2014 Yuen et al.
2015/0031970 A1 1/2015 Lain
2015/0057128 A1 2/2015 Ishii
2015/0148619 A1 5/2015 Berg et al.
2015/0177083 A1 6/2015 Redmond
2015/0190250 A1 7/2015 Braun et al.
2015/0190669 A1 7/2015 Matsuura et al.
2015/0230719 A1 8/2015 Berg et al.
2015/0258360 A1 9/2015 von Hoffmann et al.
2015/0258362 A1 9/2015 Cornish
2015/0351665 A1 12/2015 Ross
2015/0351991 A1 12/2015 Amundson et al.
2016/0038783 A1 2/2016 Matsuura et al.
2016/0062333 A1 3/2016 Jayaraman
2016/0101338 A1 4/2016 Daniels et al.
2016/0107309 A1 4/2016 Walsh et al.
2016/0128632 A1 5/2016 Wiebe et al.
2016/0199685 A1 7/2016 von Hoffmann et al.
2017/0274249 A1 9/2017 Moebius et al.

OTHER PUBLICATIONS

U.S. Appl. No. 14/667,629 (U.S. Pat. No. 9,770,617), filed Mar. 24, 2015, Low Profile Passive Exercise Garment.
U.S. Appl. No. 14/217,576 (U.S. Pat. No. 9,327,156), filed Mar. 18, 2014, Detachable Component Muscle Toning Garment.
U.S. Appl. No. 14/450,228 (U.S. Pat. No. 9,433,814), filed Aug. 2, 2014, Toning Garment With Integrated Damper.
U.S. Appl. No. 14/665,947, filed Mar. 23, 2015 Toning Garment With Offset Rotational Axis Compensation.
U.S. Appl. No. 14/887,046 (U.S. Pat. No. 9,375,603), filed Oct. 19, 2015, Garment for Elevating Physiological Load Under.
U.S. Appl. No. 15/560,150, filed Sep. 20, 2017, Dynamic Proprioception.
U.S. Appl. No. 15/078,250, filed Mar. 23, 2016, Toning Garment with Modular Resistance Unit Docking Platforms.
U.S. Appl. No. 15/600,535, filed May 19, 2017, Toning Garment with Modular Resistance Unit Docking Platforms.
U.S. Appl. No. 15/593,138, filed May 11, 2017, Wearable Resistance Devoce with Power Monitoring.
ANT (network)' (Wikipedia). Mar. 4, 2015. Retrieved from the Internet on May 17, 2016. URL:<https://web.archive.org/web/20150304152715/http://en.wikipedia.org/wikio/ANT_(network).

* cited by examiner

TONING GARMENT WITH MODULAR RESISTANCE UNIT DOCKING PLATFORMS

BACKGROUND OF THE INVENTION

Resistance training, sometimes known as weight training or strength training, is a specialized method of conditioning designed to increase muscle strength, muscle endurance, tone and muscle power. Resistance training refers to the use of any one or a combination of training methods which may include resistance machines, dumbbells, barbells, body weight, and rubber tubing.

The goal of resistance training, according to the American Sports Medicine Institute (ASMI), is to "gradually and progressively overload the musculoskeletal system so it gets stronger." This is accomplished by exerting effort against a specific opposing force such as that generated by elastic resistance (i.e. resistance to being stretched or bent). Exercises are isotonic if a body part is moving against the force. Exercises are isometric if a body part is holding still against the force. Resistance exercise is used to develop the strength and size of skeletal muscles. Full range of motion is important in resistance training because muscle overload occurs only at the specific joint angles where the muscle is worked. Properly performed, resistance training can provide significant functional benefits and improvement in overall health and well-being.

Research shows that regular resistance training will strengthen and tone muscles and increase bone mass. Resistance training should not be confused with weightlifting, power lifting or bodybuilding, which are competitive sports involving different types of strength training with non-elastic forces such as gravity (weight training or plyometrics) an immovable resistance (isometrics, usually the body's own muscles or a structural feature such as a door frame).

Whether or not increased strength is an objective, repetitive resistance training can also be utilized to elevate aerobic metabolism, for the purpose of weight loss, and to enhance muscle tone.

Resistance exercise equipment has therefore developed into a popular tool used for conditioning, strength training, muscle building, and weight loss. Various types of resistance exercise equipment are known, such as free weights, exercise machines, and resistance exercise bands or tubing.

Various limitations exist with the prior art exercise devices. For example, many types of exercise equipment, such as free weights and most exercise machines, are not portable. With respect to exercise bands and tubing, they may need to be attached to a stationary object, such as a closed door or a heavy piece of furniture, and require sufficient space. This becomes a problem when, for example, the user wishes to perform resistance exercises in a location where such stationary objects or sufficient space are not readily found.

Resistance bands are also limited to a single resistance profile in which the amount of resistance changes as a function of angular displacement of the joint under load. This may result in under working the muscles at the front end of a motion cycle, and over working the muscles at the back end of the cycle. Conventional elastic devices also provide a unidirectional bias that varies in intensity throughout an angular range but not in direction. Such devices thus cannot work both the flexor and extensor muscles of a given motion segment without adjustment, and may be uncomfortable due to the constant bias even in the absence of motion.

A need therefore exists for low profile resistance based wearable toning garments that may be used on their own without the need to employ other types of equipment, that free the wearer for other simultaneous activities, and that can apply a non-elastic load throughout both a flexion and extension range of motion.

SUMMARY OF THE INVENTION

There is provided in accordance with one aspect of the present invention, a technical garment configured to receive a modular, interchangeable resistance element. The garment comprises a waist portion with right and left lateral sides, and right and left legs. A first connector is carried by the right lateral side and a second connector is carried by the left lateral side of the garment. The first and second connectors are rotatable with respect to the waist portion of the garment in an as worn configuration through an angle of no more than about 5 degrees upon application of a rotational torque of about 8 inch pounds to the first and second connector.

In some implementations the first and second connectors are rotatable with respect to the waist portion of the garment in an as worn configuration through an angle of no more than about 15 degrees or 10 degrees or no more than about 5 degrees upon application of a rotational torque of about 12 inch pounds to the first and second connector. The first and second connectors may be rotatable with respect to the waist portion of the garment in an as worn configuration through an angle of no more than about 10 degrees or 5 degrees upon application of a rotational torque of about 8 inch pounds to the first and second connector. The first and second connectors may be rotatable with respect to the waist portion of the garment in an as worn configuration through an angle of no more than about 3 degrees upon application of a rotational torque of about 12 inch pounds to the first and second connector.

At least one of the first and second connectors may comprise a post. The post may comprise at least one spline. Alternatively, at least one of the first and second connectors may comprise an aperture.

At least one of the first and second connectors may be carried by a docking platform. The docking platform may be attached to the garment either directly or by a force transfer layer. The docking platform may be attached to the force transfer layer or the garment by stitching and/or adhesive. The force transfer layer may be attached to the garment such as by adhesive and/or stitching.

The technical garment may comprise at least one panel of compression fabric. In some implementations, at least the waist portion comprises a compression fabric. The compression fabric may exhibit at least 30% stretch prior to tensile failure. The compression fabric may exhibit at least 50% or at least 80% stretch prior to tensile failure.

The technical garment may comprise a third connector carried by the right leg and a fourth connector carried by the left leg for cooperating with the first and second connectors to receive a right and left resistance assembly spanning the axis of rotation of the hip. The third and fourth connectors may comprise openings on the right and left leg of the garment for receiving femoral levers on the right and left resistance units. The technical garment may further comprise a lever extending from each of the right and left docking platform and attached to the waist portion of the garment. The lever may extend superiorly within 90 degrees in an anterior posterior direction from the coronal plane. The lever may extend superiorly within 45 degrees in an anterior posterior direction from the coronal plane. The lever may extend superiorly and reside on the coronal plane. The lever may comprise a longitudinal axis and a transverse "T" section which extends in a circumferential direction with respect to the waist portion. The lever may alternatively comprise a "V" configuration with a connector at the apex.

The combination of the fabric of the garment, the docking platform and the force dissipation layer provide sufficient resistance to rotation of the connectors on the docking platform relative to the garment to allow sufficient transfer of force between the docking platform and the garment without significant twisting or wrinkling of the fabric of the garment under the intended loads imposed by resistance units mounted on the connectors. Each of the left and right resistance units provide at least about 2 inch pounds of torque, and in some embodiments at least about 5 or 7 or 10 or 12 or 15 or more inch pounds of torque for toning garments built on a platform such as a compression pant, non-compression (non-stretch) tight fit pant, 4 way stretch denim or other depending upon the desired performance.

Further features and advantages of the present invention will become apparent to those of skill in the art in view of the detailed description of preferred embodiments which follows, when considered together with attached drawings and claims.

DETAILED DESCRIPTION OF THE PREFERRED EMBODIMENT

Figure 1:
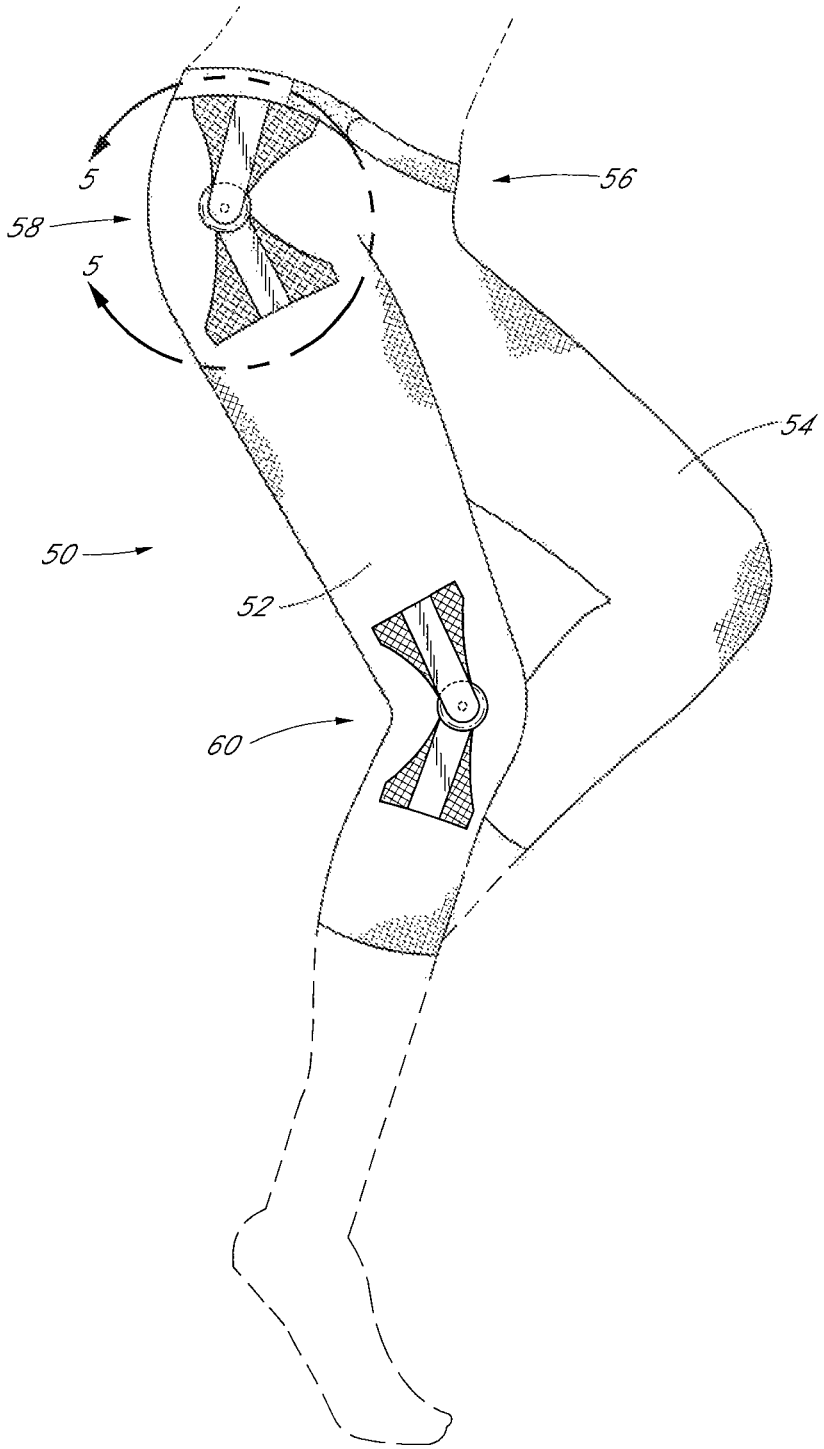
FIG. 1 is a side elevational view of a toning garment showing a right hip and a right knee resistance unit.

Detailed descriptions of the preferred embodiments are provided herein. It is to be understood, however, that the present invention may be embodied in various other forms. Therefore, specific details disclosed herein are not to be interpreted as limiting, but rather as a basis for the claims and as a representative basis for teaching one skilled in the art to employ the present invention in virtually any appropriately detailed system, structure or manner.

In general, the devices in accordance with the present invention are designed to provide resistance to motion between a first region and a second region of the body such as across a simple or complex joint, (e.g., hip, knee, shoulder, elbow, etc.), throughout an angular range of motion. The resistance can be either unidirectional, to isolate a single muscle or muscle group, or preferably bidirectional to exercise opposing muscle pairs or muscle groups. Optionally, the device will be user adjustable or interchangeable to select uni or bidirectional resistance, and/or different resistance levels.

The specific levels of resistance will vary depending upon the targeted muscle group, and typically also between flexion and extension across the same muscle group and the training or toning goal. Also wearer to wearer customization can be accomplished, to accommodate different training objectives. In general, resistances of at least about 10, and often at least about 15 or 18 or 20 or more inch-pounds will be used in heavy toning or strength building applications on both flexion and extension. All torque ratings described herein represent the torque measured at 40 degrees per second, which is an angular velocity that approximates walking.

Toning garments intended for long term wear or lighter toning may have lower resistance, with extension normally equal to or greater than flexion. Torque provided by a resistance element intended for the hip for toning garments may be at least about 4 in-lbs., sometimes at least about 6 or 8 or 10 or more in-lbs. depending upon the desired result, measured at 40 degrees per second. Torque will typically be less than about 20 in-lbs., and often less than about 16 or 14 in-lbs. In some implementations, torque will be within the range of from about 2-6 in-lbs. for a 'light' toning element; within the range of from about 6-12 in-lbs. for a 'medium' toning element; and within the range of from about 12-20 in-lbs. for a 'heavy' toning element.

Devices specifically configured for rehabilitation (following stroke, traumatic injury or surgical procedure) may have the same or lower threshold values as desired.

Resistance experienced by the wearer is generated by a resistance element having a housing and a lever rotatable about a pivot point with respect to the housing. Rotation of the lever with respect to the housing encounters a preset level of rotational resistance generated by the internal operation of the resistance element.

The lever is secured within the leg of the garment so that it moves with the wearer's leg throughout the stride relative to a pivot point on the upper, lateral side of the hip. During a normal stride, the femur rotates about a transverse axis of rotation which extends from side to side through the approximately spherical right and left femoral heads, as they rotate within the corresponding right and left complementary acetabular cups in the pelvis. The pivot point on each of the right and left sides of the garment aligns approximately with that natural axis of rotation.

A connector is attached to the garment approximately at the pivot point and secured to prevent rotation of the connector. As long as the connector is restrained from rotating relative to the wearer's waist, the wearer will experience resistance imparted by the resistance element throughout the stride cycle. However, if the resistance exceeds a predetermined rating for a given garment, torque from the wearer's stride may cause the connector to rotate, by stretching the fabric in a twisting pattern concentrically about the axis of rotation. Twisting of the connector about its axis will absorb torque generated by the resistance element, thereby reducing the resistance perceived by the wearer, and the effectiveness of the system.

In view of the foregoing, the connector is secured with respect to the garment in a manner that will not permit it to rotate during use of a resistance element for which the garment is rated. Thus, there is an interplay between the stretch of the garment, the maximum anticipated torque applied by the wearer, and the manner in which the resistance element is secured to the garment. A connector mounted on a non-stretch garment, a garment fabricated with non-stretch panels or straps, or a harness constructed with non-stretch materials may be able to function under substantial applied loads without failure. Garments with higher stretch fabric and/or lower tensile strength to failure levels will only support relatively lower applied torque levels, unless supplemented with lower stretch filaments, lower stretch fabrics or other reinforcement straps or materials as will be appreciated by those of skill in the art.

In general, a garment 'failure' point is considered to have been achieved when the amount of rotational torque applied to the connector will rotate the connector (by stretching/deforming the garment) at least about 15 degrees, while the garment is being worn by a person or equivalent three dimensional fixture that stretches the garment within the range intended by the manufacturer (the garment is of the appropriate size for the wearer or fixture). Preferably, the connector will rotate no more than about 10 degrees, or no more than about 5 degrees, or optimally no more than about 3 degrees upon application of the maximum rated torque for that garment.

Figure 14A:
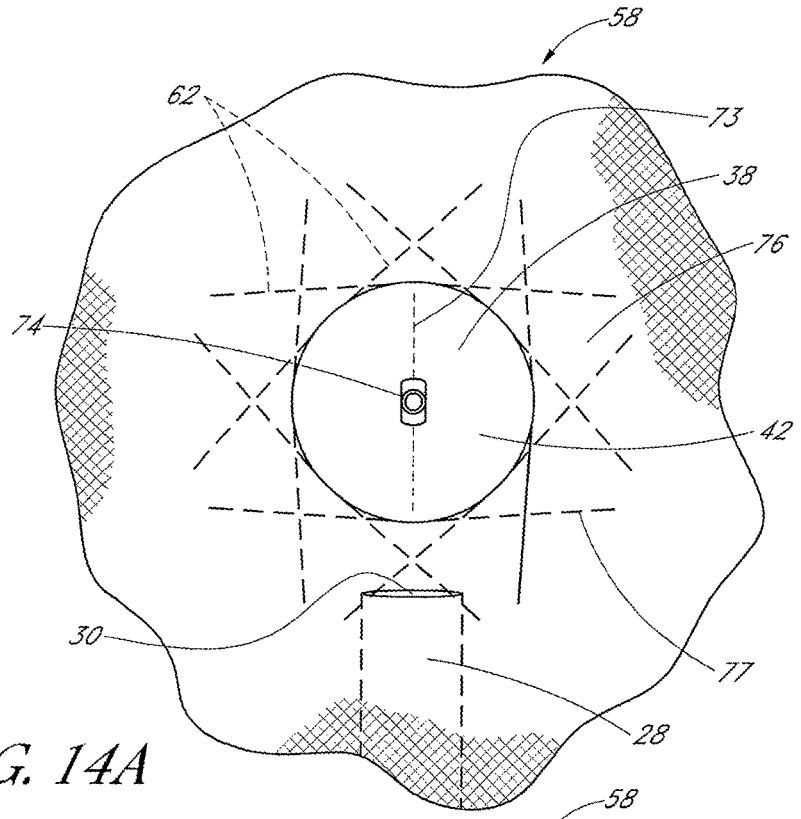
FIG. 14A is a detail view taken along the line 14-14 in FIG. 13.
Figure 14B:
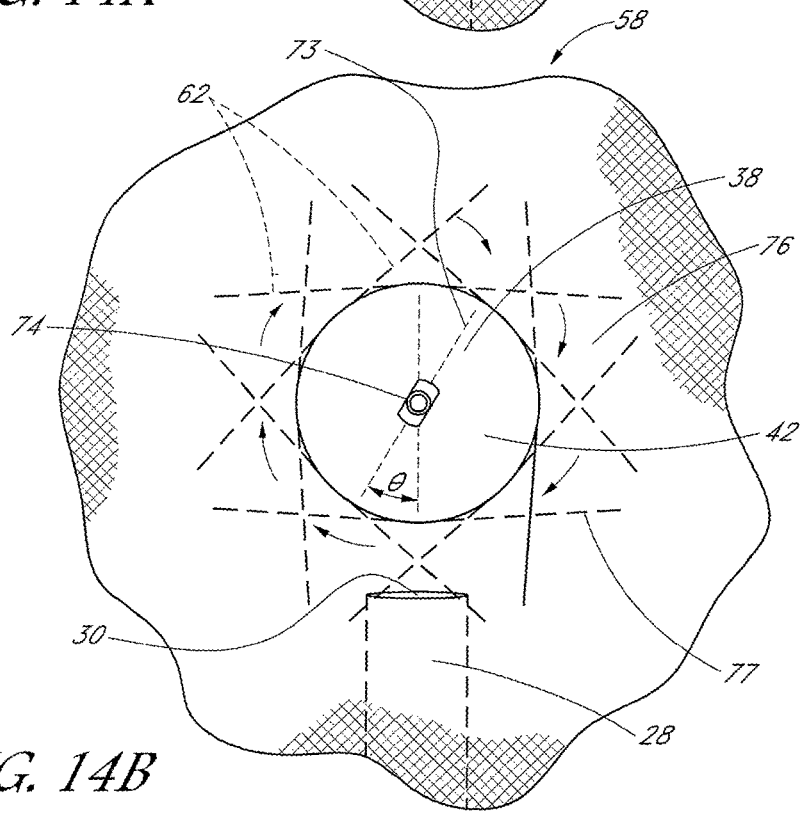
FIG. 14B is a detail view as in FIG. 14A, showing a clockwise twisting of the fabric in response to rotational torque applied to post 74.

Rotational deformation of the fabric garment is illustrated in FIGS. 14A and 14B. In FIG. 14A, a reference line 73 shows the rotational orientation of the post 74, described in additional detail below. If a sufficient clockwise rotational torque is applied to the post 74, the post 74 will rotate through an angle theta as shown in FIG. 14B, by a stretching of the adjacent underlying fabric.

A light weight toning garment, for example, depending upon the garment stretch characteristics, may be able to withstand application of at least about 6 or 8 or 10 inch pounds of torque, before rotation of the connector through an angle of 5 degrees or other specified rating. A higher resistance garment may be able to withstand application of at least about 10 or 12 or 14 inch pounds of torque, before exceeding its rating. More athletic garments or harnesses, with woven nylon or leather straps for example, can be configured to withstand applied torques of at least about 20 or 25 or 30 or more inch pounds, depending upon the intended performance. Optimization of the foregoing variables for a particular product can be accomplished by those of skill in the art in view of the disclosure herein, to obtain a garment and resistance unit pairing that meet the desired performance characteristics.

Referring to FIG. 1, there is illustrated a toning garment 50 in accordance with the present invention. The toning garment 50 includes a right leg 52, a left leg 54, and a waist 56. As for all garments disclosed herein, the toning garment 50 will normally be bilaterally symmetrical although garments may be provided with a left side only or right side only resistance element. Accordingly, only a single side will be discussed in detail herein.

Figure 25:
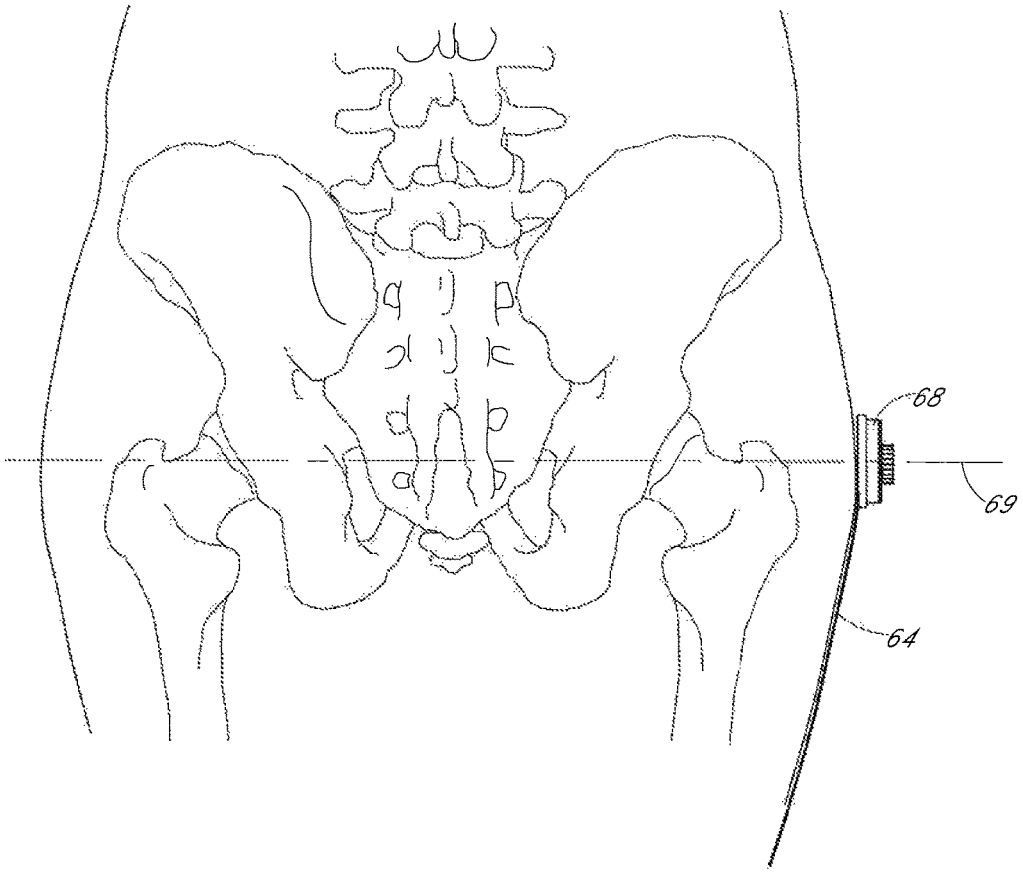
FIG. 25 is a posterior elevational view of a human pelvis, showing the axis of AP plane rotation relative to the iliac crest and a right side resistance unit of the present invention in an as worn orientation.

In the illustrated embodiment, the right leg 52 is provided with a hip resistance unit 58. Right leg 52 is additionally provided with a knee resistance unit 60. Each leg of the toning garment 50 may be provided with either the hip resistance unit 58 or the knee resistance unit 60, with or without the other. The left and right hip resistance units will preferably have an axis of rotation that is functionally aligned with a transverse axis of rotation which extends through the wearer's left and right hip axes of rotation. See, e.g., FIG. 25. Functional alignment includes precise alignment (coaxial) however due to the different fit that will be achieved from wearer to wearer, precise alignment may not always occur. Due to the stretchability of the garment, minor misalignment may self correct or not present adverse performance. Similarly, the knee resistance units, if present, will preferably have an axis of rotation that is functionally aligned with the transverse axis of rotation that extends through the center of rotation of each knee.

Figure 2:
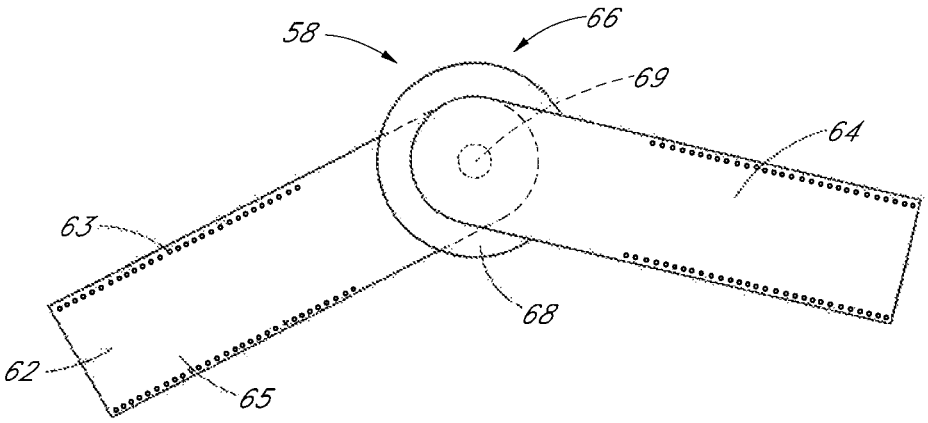
FIG. 2 is a plan view of a toning garment resistance unit.

Referring to FIG. 2, the hip resistance unit 58 will be described in further detail. The left and right hip resistance units, and both the right and left leg knee resistance unit 60 may be constructed in a similar manner although may impart different torque levels.

The hip resistance unit 58 is provided with a first attachment such as a first lever 62, and a second attachment such as a second lever 64 connected by a pivotable connection 66. The pivotable connection 66 comprises a resistance element 68 which provides resistance to angular movement between a primary longitudinal axis of first lever 62 and a primary longitudinal axis of second lever 64. In the as worn orientation, the axis of rotation 69 is preferably substantially aligned with an axis of rotation of the joint with which the resistance element is associated.

A lever as used herein refers to a structure that mechanically links a docking plate, connector, housing or resistance element to a portion of the garment or wearer at or above or below the resistance unit, so that movement of the wearer is resisted by the resistance unit and applies a torque to the point of attachment to the garment without undesirable stretching or wrinkling of the garment. The lever may take a conventional form, as illustrated in FIG. 2, and comprise an elongate element having a length generally at least about 2 inches, in some embodiments at least about 4 or 6 or 8 inches to provide better leverage and attachment force distribution. The element may a have a width of at least about 0.25 inches, and in some embodiments at least about 0.5 inches or 1.0 inches or 2 inches or more but normally less than about 3 inches or 2.5 inches. The thickness may be less than about 0.25 inches, preferably less than about 0.125 inches and in some embodiments less than about 0.050 inches to maintain a low profile that can be concealed within or underneath the fabric of the garment. The lever may comprise a two part telescoping element, with a rod axially movably carried by a support such as a tube, as is discussed further below. The lever may comprise any of a variety of washable, non-corrosive materials such as nylon, Teflon, polyethylene, PEBAX, PEEK or others known in the art. Preferably the lever arm has sufficient structural integrity to transmit force in the anterior-posterior direction in the case of hip and knee resistance units, but is flexible in the medial-lateral direction to enable the garment to follow the contours of the body. See, e.g., FIG. 25.

The inferior and superior lever arms may be similar to each other for a resistance unit mounted at the knee. For a resistance unit mounted at the hip, the lever arms may be distinct. For example, the inferior lever arm at the hip may conveniently comprise an elongated femoral lever, such as that illustrated in FIG. 1 or 16, in which the axial length of the lever is at least about two times, and may be at least about three times or five times its width. This lever arm can extend down the lateral side of the leg, secured by the garment approximately parallel to the femur.

The superior lever arm may have a vertical component extending upward in the coronal plane towards the waist, with a bend or "T" so that a superior component extends in a transverse direction, either partially or completely circumferentially around the waist of the wearer. The transverse component may comprise a stretch fabric or relatively inelastic belt with a buckle or fastener. The superior lever may take the form of a "V" with the connector at the bottom (apex) of the V and the legs of the V stitched or otherwise bonded to the waist.

Alternatively, the superior lever arm may comprise a fabric, polymeric, or metal (e.g. Nitinol mesh) force transfer patch, such as a circular, square, rectangular, oval, "T" or other shape which can be secured to the rotational damper or a docking station for receiving the rotational damper, and also secured to the garment or the wearer in a manner that resists rotation of the damper with respect to the garment during movement of the inferior lever. Thus, "lever" as used herein is a force transfer structure which resists rotation of the dock and is not limited to the species of a conventional elongate arm.

Figure 8:
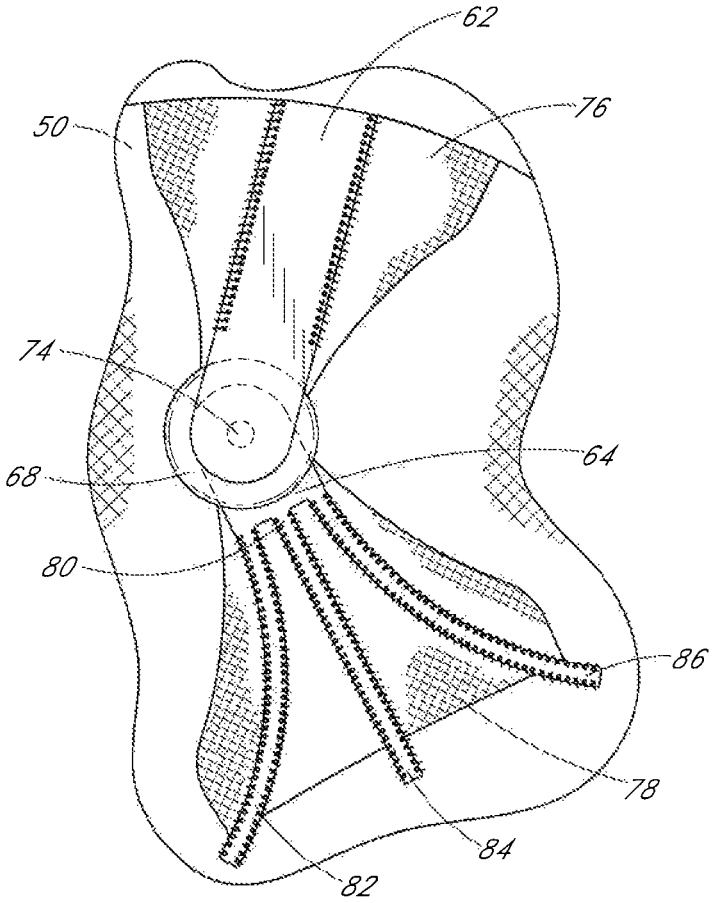
FIG. 8 is a resistance unit secured to a garment, showing an alternative reinforced femoral attachment configuration.

Either the superior or inferior lever may comprise a docketing platform for attachment to the resistance unit, and a plurality of two or three or four or more legs such as straps that are secured such as by stitching or adhesive bonding to the garment. See FIG. 8 in which a dock 80 supports at least an anterior element 82, a medial element 84 and a posterior element 86. Each of the elements is preferably relatively inflexible in the anterior-posterior direction, but flexible in the medial-lateral direction to enable the anterior element 82 to wrap at least partially around the side and optionally around the front of the leg. The posterior element 86 preferably wraps at least partially around the posterior side of the leg. The lever elements can be configured as a system of straps. The elements can comprise one or more strands or technical fabric supports, sufficient to transmit the forces involved in a given garment and resistance unit system.

Figure 5:
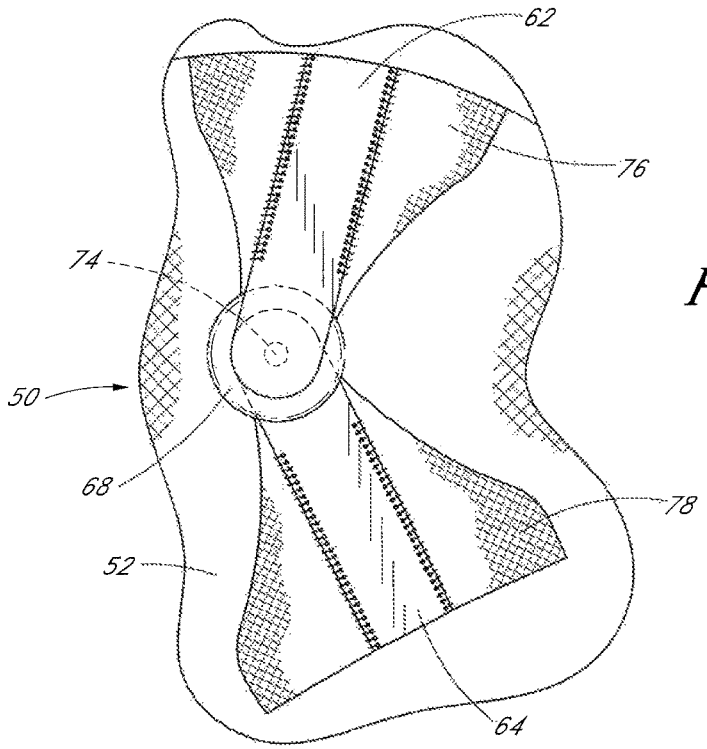
FIG. 5 is a resistance unit as in FIG. 2, attached to a garment with force distribution layers.
Figure 6:
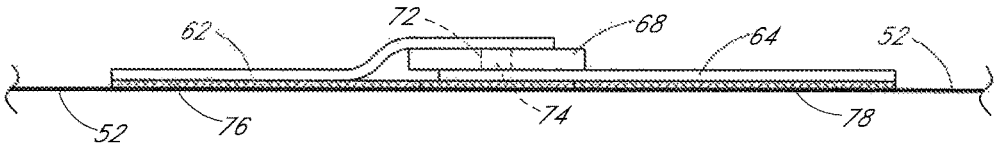
FIG. 6 is a side elevational view of the resistance unit and garment assembly of FIG. 5.

The hip resistance unit 58 may be secured to the toning garment 50 in any of a variety of ways. Referring to FIGS. 2 and 5, the first lever 62 is provided with at least a first set of apertures 63 and optionally a second set of apertures 65 to receive a filament such as a polymeric or fabric thread, for sewing the hip resistance unit 58 to the garment. Stitching may alternatively be accomplished by piercing the first lever 62 directly with the sewing needle, without the need for apertures 63 or 65. Alternatively, the first lever 62 can be secured to the garment using any of a variety of fastening techniques, such as adhesive bonding, grommets or others known in the art.

Since torque equals force times radius or length, a lever is convenient to distribute force to the garment. The inferior lever can extend inferiorly along the coronal plane, along a portion of the length of the femur. The longitudinal axis of the first, superior attachment at the hip may be transverse to the longitudinal axis of the second lever 64 at the midpoint of its range of motion, such that the first lever is aligned like a belt, circumferentially extending along a portion of or approximately parallel to the wearer's waist displaced superiorly from the axis of rotation of the wearer's hip. Normally the hip axis of rotation will be offset inferiorly by at least about 3 inches, and often 5 inches or more from the iliac crest, which approximates the top of the belt line for many wearers. Alternatively, the housing of the resistance element or docking platform may be sewn or adhesively bonded or otherwise attached directly to reinforced fabric at the hip such as by circular weaving or stitching techniques known in the art.

The resistance element 68 may be any of the resistance elements disclosed in U.S. patent application Ser. No. 14/665,947 filed Mar. 23, 2015, now published as U.S. 2015/0190669, the disclosure of which is hereby incorporated by reference in its entirety herein. In one embodiment, resistance element 68 may comprise a rotary damper containing a fluid such as air, water or a viscous media such as silicone oil. The rotary damper may be rated to provide anywhere within the range of from about 0.1 inch pounds to about 50 inch pounds torque at a rotational velocity of 40 degrees per second depending upon the joint or other motion segment to be loaded and desired intensity. Typical torque ranges are disclosed elsewhere herein.

Resistance imposed at the knee will generally be less than at the hip. Values of generally no more than about 85% or 50% or 35% of the torque at the hip may be desirable in a toning garment at the knee, measured at 40 degrees per second. As discussed elsewhere herein, the resistance element at any given joint can provide the same or different resistance (including zero) upon flexion or extension.

Figure 3:
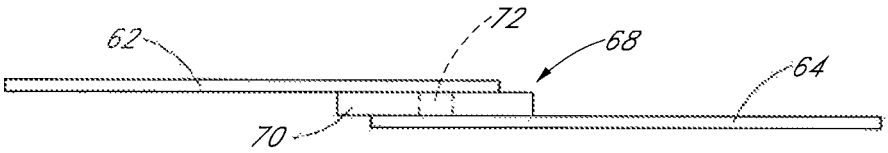
FIG. 3 is a side elevational view of the resistance unit of FIG. 2.
Figure 4:
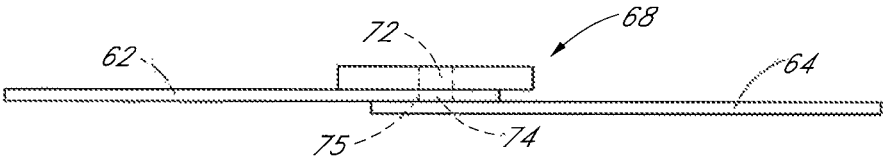
FIG. 4 is a side elevational view of an alternate configuration of the resistance unit of FIG. 2.

Referring to FIGS. 3-4, the resistance element 68 may comprise a generally disc shaped housing, having a diameter of less than about 4 or 3 or 2.5 inches, and a thickness in an axial direction of less than about 0.75 and preferably less than about 0.5 inches. A connector 72 is rotatably carried by the housing 70. Connector 72 may be a post or an aperture, having a non-circular (e.g. square, hexagonal, triangular, circular with at least one spline or flat side) keyed cross-section such that a complementary post or aperture may be axially positioned in engagement with the connector 72, to transmit rotational torque.

Referring to FIGS. 3-4, the resistance element 68 housing 70 may be secured to either the first lever 62 or the second lever 64 or neither, as is described below. The connector 72 may be secured to the other of the first lever 62 and second lever 64. Resistance element 68 thus provides resistance to motion of the first lever 62 with respect to the second lever 64, throughout an angular range of motion about the axis of rotation 70.

In an alternative configuration, the levers may be mounted on the same side of the resistance element 68 to provide an overall lower profile. Referring to FIG. 4, second lever 64 is provided with a connector 72 in the form of a post for rotationally engaging the connector on resistance element 68 which is in the form of a complementary aperture. Post 74 extends through an aperture 75 in the first lever 62. Aperture 75 has a diameter that exceeds the maximum transverse dimension of the post 74, such that post 74 may rotate without imposing any force on first lever 62. The housing of resistance element 68 is immovably secured with respect to first lever 62 such as by adhesive bonding, molding, interference snap fit or other immovable connection.

Referring to FIG. 5, a hip or knee resistance unit 68 is illustrated as secured to a garment 50 although the following description also applies to resistance elements at the elbow, wrist, ankle or knee. Depending upon the configuration of the lever arms, the stretchability of the fabric, and the level of resistance imposed by resistance element 68, one or more reinforcement or force transfer or dissipation features may be necessary to transfer sufficient force between the lever arm and the garment, while minimizing stretching or wrinkling of the garment. In the illustrated embodiment, first lever 62 is additionally provided with a first force dissipation layer 76. Force dissipation layer 76 may comprise any of a variety of meshes or fabrics, such as those disclosed previously in US 2015/0190669 and below in connection with FIG. 14.

In one implementation, the fabric comprises one or more strands of yarn or filament 77 having a vector extending in the as worn anterior posterior direction which exhibits relatively low stretch. See FIG. 14. A plurality of strands 77 can be woven in an orientation that is approximately at a tangent to at least about 2 or 4 or 8 or 10 or 50 or 100 or more points on a concentric circle around the rotational axis of the resistance element or force transfer layer to optimize resistance to rotation of the housing relative to the garment. Circular weaving or circular knitting may be used to integrate an anti-rotation force transfer layer into the garment. Force dissipation layer 76 may be attached to the edges and/or lateral and/or medial surfaces of first lever 62 or the damper housing or docking platform for receiving a damper such as by stitching, adhesives or other fastener, and extend in the anterior posterior direction beyond the edges of the first lever 62 to provide an attachment zone both anteriorly and posteriorly of the first lever 62. In the embodiment of FIG. 14, the force dissipation layer is the lever, securing the damper against rotation with respect to the adjacent fabric overlying the axis of rotation. The attachment zones may be secured to the underlying garment by stitching, adhesives or both, or straps, strands or other fasteners known in the art.

The first force dissipation layer 76 may extend beneath, within the same plane, or across the outside (lateral) surface of the first lever 62, entrapping the first lever 62 between the force dissipation layer 76 and the garment 50. Alternatively, the force transfer layer may function as a lever.

The force dissipation layer may be molded mesh or a technical fabric weave, comprising any of a variety of strands identified in US 2015/0190669 previously incorporated by reference herein. Preferably the fabric has stretch resistance along at least one axis, which can be aligned with an axis under tension during flexion or extension due to the resistance element (e.g. the AP plane). The fabric may exhibit a higher level of stretch along other axes. The fabric also preferably exhibits low weight, high breathability and high flexibility. Some suitable fabrics include shoe upper fabric from running shoes including, for example, that disclosed in US patent publication No. 2014/0173934 to Bell, the disclosure of which is incorporated by reference in its entirety herein. Additional multilayer fabrics having good flexibility, and stretch resistance along one axis and higher stretch along a transverse or nonparallel axis, useful for the force dissipation layer are disclosed in U.S. Pat. No. 8,555,415 to Brandstreet et al; U.S. Pat. No. 8,312,646 to Meschter et al; and U.S. Pat. No. 7,849,518 to Moore et al., the disclosures of each of which are incorporated in their entireties herein by reference. Typically, the force transfer layer will have lower stretch along at least one axis than the stretch of the underlying garment.

Figure 9:
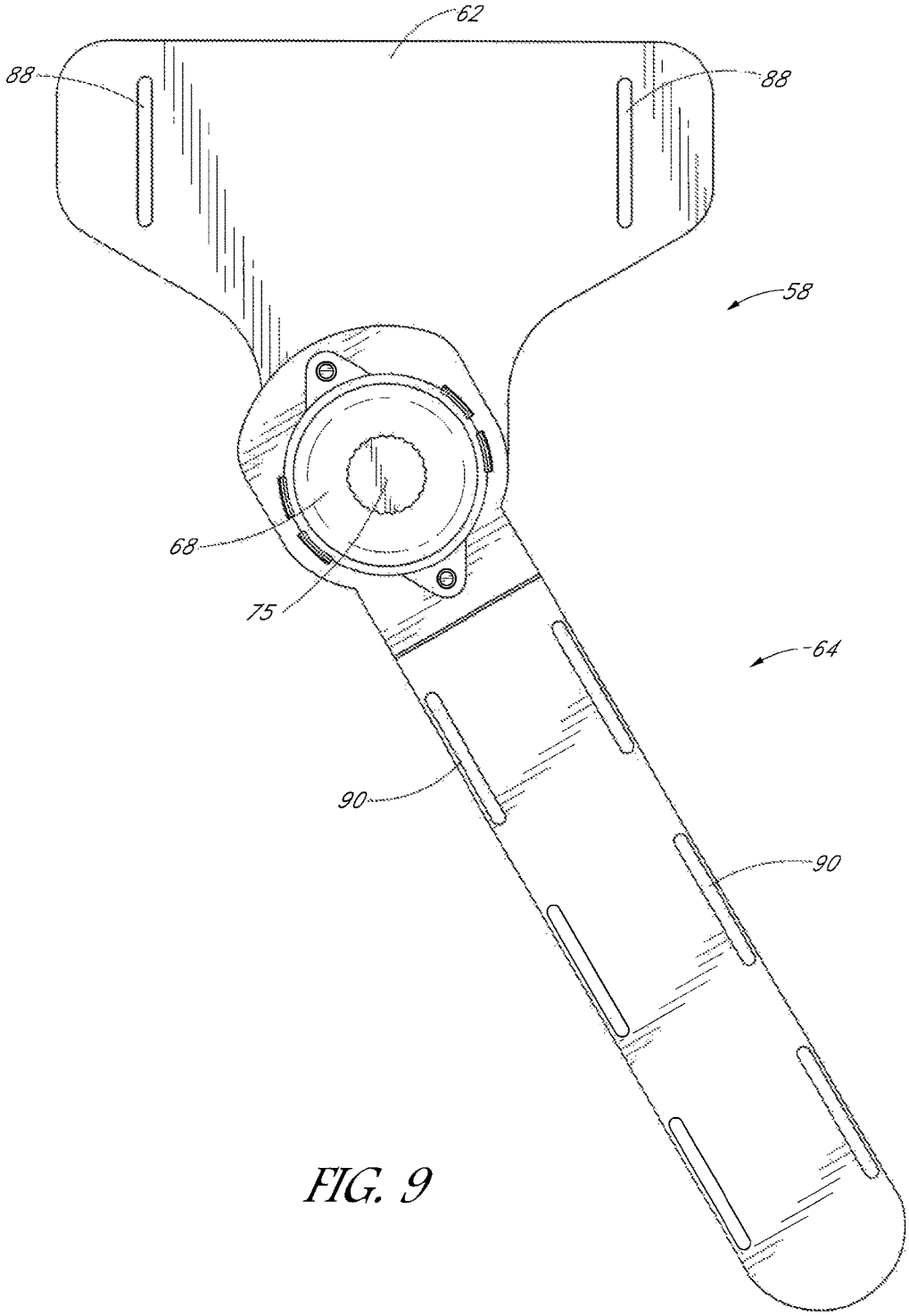
FIG. 9 is a side elevational view of a resistance unit having a superior connector, an inferior, femoral connector and a resistance element.

Referring to FIG. 9, there is illustrated a resistance unit 58 comprising a first lever 62 configured for attachment to the garment or to the wearer to at least approximately align the rotational axis of the resistance element with the hip, as discussed below. First lever 62 may be provided with any of a variety of attachment structures such as a force dissipation layer, straps, Velcro or at least one and typically two or more slots, snaps or other attachments 88 for connection to a strap, belt or other fastener associated with the garment. First lever 62 may comprise any of a variety of polymeric or metal sheets or mesh membranes, printed, molded or machined parts or fabrics disclosed elsewhere herein, which may be bonded or stitched directly to the garment, or held by a belt to the outside of the garment.

Figure 7:
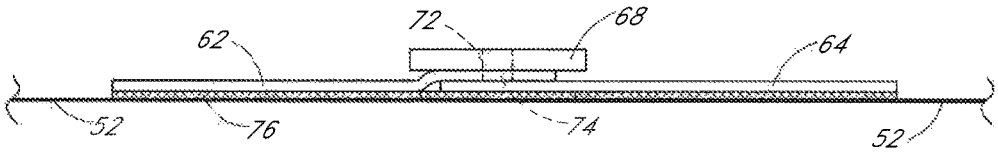
FIG. 7 is a side elevational view of an alternate configuration of the resistance unit and garment assembly of FIG. 5.

Lever 62 is pivotably connected to a second lever 64 by way of resistance element 68 as has been described. Resistance element 68 may comprise any of a variety of resistance elements, such as friction brakes, malleable materials, clutches, or rotary viscous dampers as has been discussed. Resistance element 68 may be securely permanently or removably mounted to the second lever arm 64 (as illustrated) or to first lever arm 62 or both. A post 74 (FIG. 7) is secured to the first lever arm 62, and extends through a complementary aperture in the resistance element 68. In this manner, rotation of the second lever 64 about the rotational axis of resistance element 68 with respect to the first lever 62 experiences the resistance provided by resistance element 68. Second lever 64 may be provided with a force dissipation layer and/or one or two or three or four or more inferior connectors 90. As illustrated, inferior connectors 90 may be apertures such as slots for receiving a strap or filament for securement to the pant leg or the leg of the wearer.

Preferably, a quick release 75 is provided, to engage and disengage the resistance element, and or enable disassembly into component parts. Quick release 75 is illustrated as a knob which may be rotatable, or axially movable between a first and a second position to engage or disengage the damper. Any of a variety of quick release mechanisms maybe utilized, such as a threaded engagement, or a pin or flange which can rotate into engagement behind a corresponding flange or slot. Quick release 75 allows rapid removal of the damper, or the damper and femoral lever arm, as is discussed in more detail below.

Figure 10:
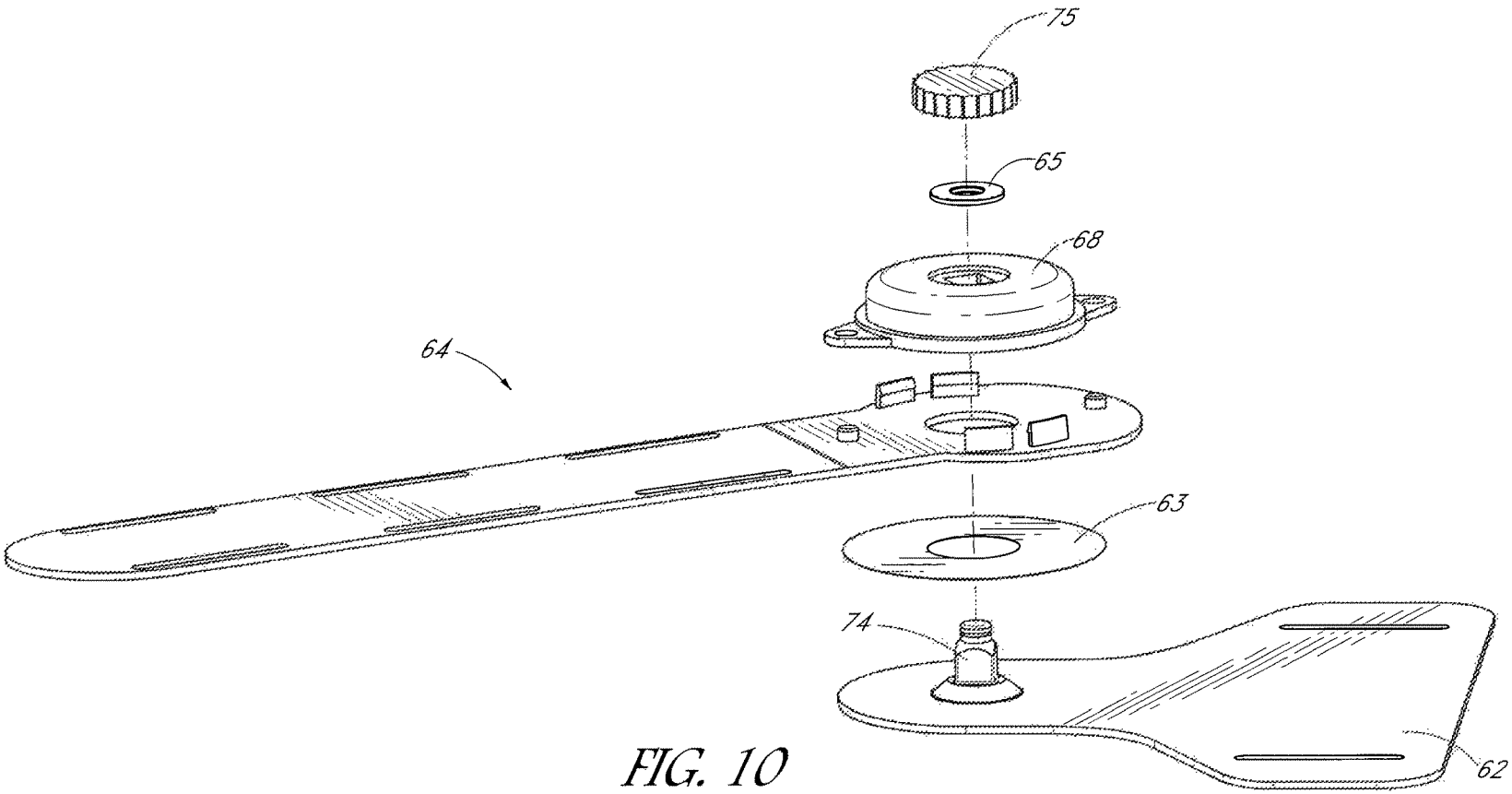
FIG. 10 is an exploded view of the resistance unit of FIG. 9.

Referring to FIG. 10, an exploded view illustrates the first lever 62 having post 74 secured thereto such that rotation of the post is transferred to the lever 62. A friction modifier 63 such as a washer or membrane that may comprise a friction reducing material such as a lubricious polymer (e.g., PTFE) may be provided to separate the first lever 62 from second level 64. Alternatively the friction modifier 63 may be a friction enhancer, such as one or two or more washers having a friction enhancing surface texture, which create resistance to movement and can therefore supplement or replace the rotational damper.

Connectors 65 may be provided for locking the construct together. Connectors 65 may comprise one or more locking rings, nuts, pins or other structure. Preferably, a quick release mechanism 75 such as a quick release lever, rotatable knob or snap fit that allows the wearer to quickly engage or disengage the resistance unit 58 into component subassemblies, as will be described.

Skeletal motion at the hip during normal activities including walking involves complex, multidirectional movement of the femoral head within the acetabular cup. However when viewed to isolate out the single component of movement in the anterior-posterior ("AP") plane, the femur swings forward and back like a pendulum, pivoting about a rotational axis 69 (FIG. 25) which extends laterally through the approximate centers of the roughly spherical left and right femoral head.

Many of the resistance elements disclosed herein exhibit a fixed axis of rotation. Ideally, the exercise garment of the present invention of the type having a fixed rotational axis can be worn by a wearer such that the rotational axis of the resistance element is coincident with the rotational axis 69 of the femur. However, due to a combination of factors including the stretch of the fabric and dissimilarities from wearer to wearer in the contour of the soft tissue between the femur and the garment, the two rotational axes may not perfectly align. An imaginary straight-line in the AP plane which connects the anatomical rotational axis and the rotational axis of the resistance element defines a non-zero offset in the case of misalignment between the two axes of rotation which has the effect of a piston like pulling or pushing the second lever 64 along its longitudinal axis relative to the femur throughout the stride cycle. If force in all directions from the second lever 64 is effectively transmitted to the garment, this axial reciprocal movement of the second level 64 with respect to the wearer and garment through the offset distance 26 may cause a variety of undesirable results, including chafing of the garment up and down against the leg, wrinkling, buckling or damaging the fabric of the garment and/or the material of the second lever 64.

It may therefore be desirable to decouple axial movement of the second lever 64 from the garment, while maintaining a high degree of force transmission between the second lever 64 and the garment in the AP plane.

Figure 13:
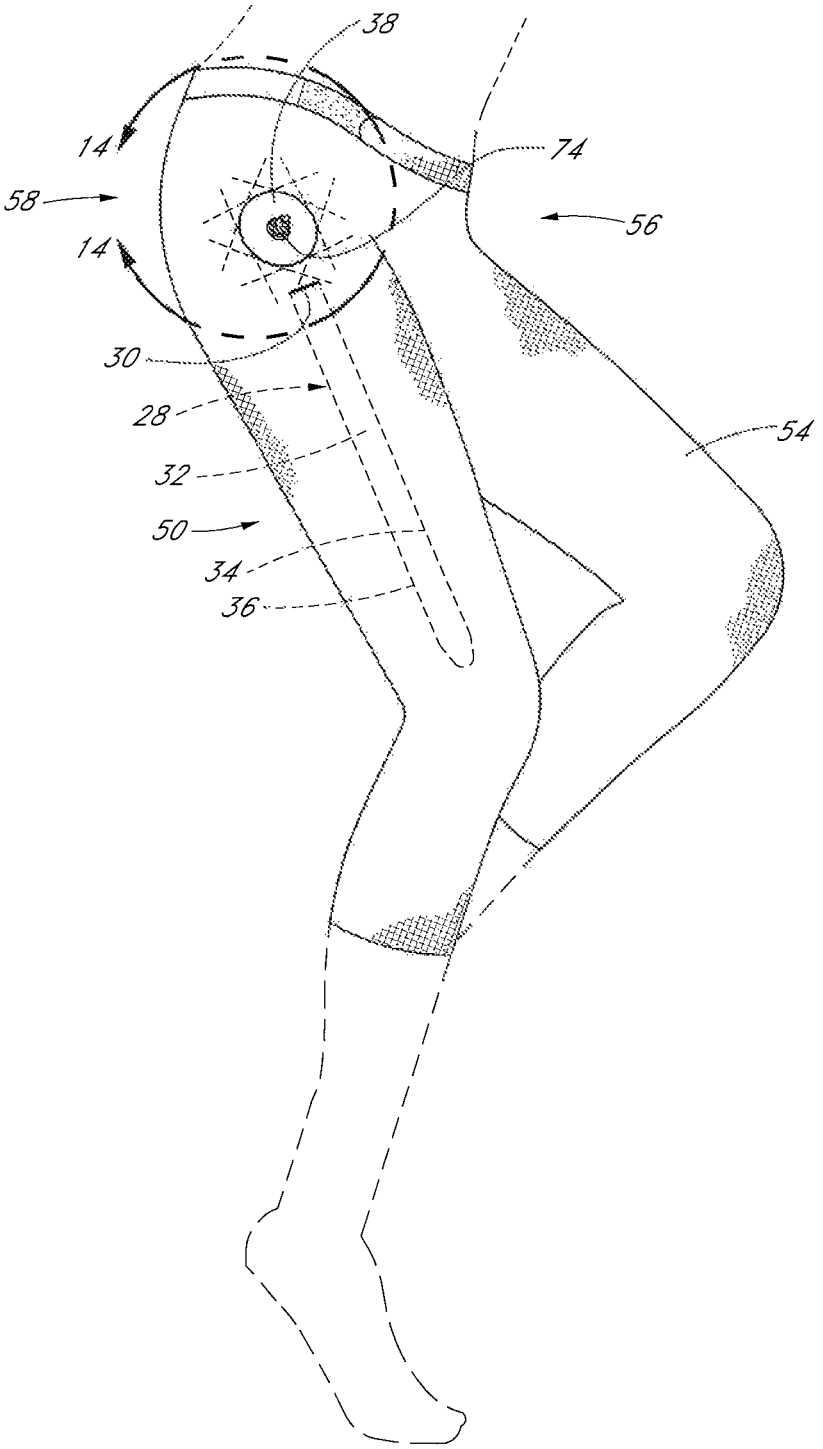
FIG. 13 is a side elevational view of a lower body garment, having a resistance unit docking station aligned with the hip.

Referring to FIG. 13, one convenient structure for accomplishing the foregoing is to provide an elongated pocket 28 extending in an inferior superior direction along the lateral side of each leg of the garment. The pocket 28 comprises an opening 30 at a superior end thereof, providing access to an elongate cavity, for removably receiving the second lever 64. An anterior limit 34 of the pocket 28 and a posterior limit 36 of the pocket 28 are dimensioned relative to the width of the second lever 64 to provide a snug fit against relative AP movement, but which permits axial sliding of the second lever 64 along its longitudinal axis within the pocket. The axial length of the pocket exceeds the axial length of the second level 64, thereby enabling the second level 64 to reciprocate up and down within the pocket 28 without transmitting inferior superior axis movement to the garment.

The axial length of the pocket 28 is preferably at least about 4 inches, and in some implementations it is at least about 6 inches or 8 inches or more in length, depending upon the garment size, fabric stretch and resistance level of the resistance unit. The length of the pocket will preferably exceed the length of the associated lever by an amount sufficient to compensate for the likely offset between the rotational axis of the hip and the rotational axis of the damper. Typically, that offset will be no more than about 2 inches, and preferably no more than about 1 inch or 0.5 inches.

The lever 64 will preferably axially reciprocate within the pocket 28 with minimal friction. For this purpose, the lever may be constructed from or coated with a lubricious material. In addition, the interior surface of the pocket preferably comprises a material with a low coefficient of friction with respect to the surface of the lever. The interior of the pocket 28 may be provided with one or two or five or 10 or more axially extending filaments or raised ridges, to reduce the contact surface area between the lever 64 and the pocket 28. The interior of the pocket 28 may be lined either partially or completely with a membrane having a low friction surface. Thus, a pocket liner comprising any of a variety of materials such as nylon, PTFE, polyethylene terephthalate, PEEK, metal films or other materials may be utilized depending upon the intended performance characteristics.

The inside width of the pocket is preferably dimensioned such that the lever is not able to move significantly in the AP plane with respect to the pocket. The width of the pocket with the lever installed therefore preferably only exceeds the width of the lever by a sufficient amount to permit the desired axial movement of the lever without transferring axial movement to the garment. The width may be adjustable between a larger width such as for inserting the lever, and a smaller width for efficient lateral force transfer. That may be accomplished by fabricating the pocket from compression fabric so that it stretches to receive the lever. Alternatively, a zipper may be advanced along the length of the pocket to bring two parallel edges closer together, with straps connected to the pant leg on one side of the pocket and connectable (e.g., with Velcro) to the pant leg on an opposite side of the pocket.

Alternatively, the resistance unit 58 can be provided with any of a variety of axial expansion dampers, positioned between the rotational axis of resistance element 68 and a portion of the second lever 64 which is immovably secured to the garment. Axial extension dampers may include first and second side by side or concentric telescoping components, which through relative axial sliding motion allow the second lever 64 or other attachment point to the garment to reciprocally lengthen and shorten. See, e.g., FIGS. 27-29 discussed below. Alternative structures such as springs, collapsible diamond shaped cells, etc., can allow axial shortening and lengthening of the second lever 64 between the rotational axis and the point of attachment to the garment so that axial reciprocating movement of the femoral lever is not transmitted to the garment. The proximal end of the lever may be provided with an adjustable attachment element such as an elongate, axially extending slot which receives a complementary attachment element such as a post on the damper having two opposing flat sides so that the lever can reciprocate axially but remain rotationally keyed to the post.

Referring to FIG. 13, there is illustrated a garment having a docking station 38 for releasably receiving a resistance module 68. As illustrated in FIG. 14, the docking station 38 comprises a platform 42 for receiving a damper or other resistance module. The platform 42 comprises at least one connector 74, for connecting with the resistance module. The connector may be a post or an aperture, for keyed connection with a corresponding connector on the damper or other resistance module. The platform 42 or connector 74 may be provided with a quick release feature 44, for releasably engaging a complementary quick release control such as a lever, button or rotatable knob as has been discussed.

Figures 11, 12:
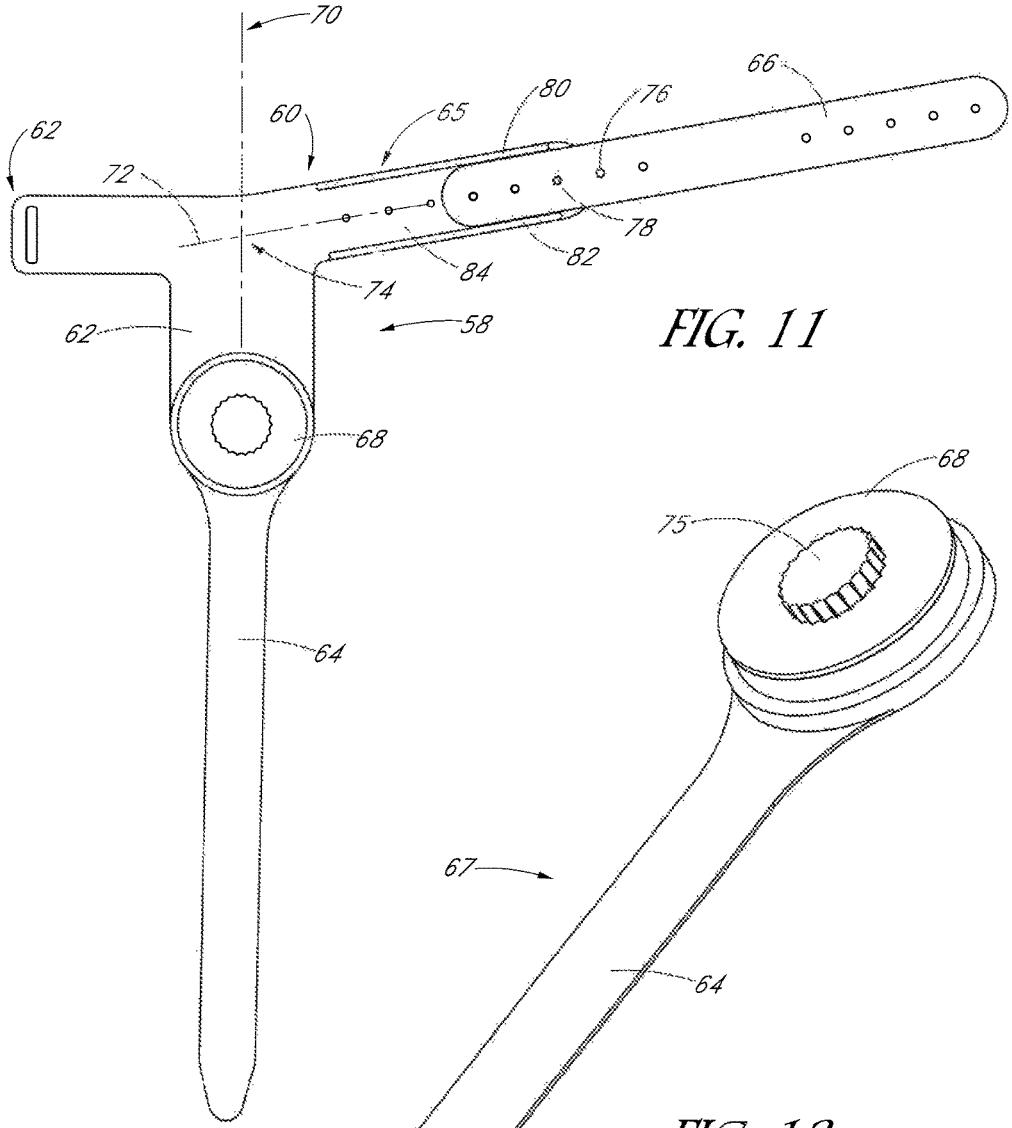
FIG. 11 is a side elevational view of a left side resistance unit, having a posterior connector for connection to a right side resistance unit.
FIG. 12 is a perspective view of a detachable, modular resistance unit, having a resistance element and a femoral lever arm.

Referring to FIG. 11, there is illustrated a left side resistance unit 58 in the form of a harness or belt, or subassembly that can be attached to or integrated into a compression pant or other garment. The right side is omitted for clarity. The resistance unit 58 comprises a femoral lever 64 and a resistance element 68 as has been described. In this illustration, the first lever 62 is in the form of an approximately "T" or "Y" shaped hip support 60, configured to minimize the risk of rotation of the resistance element 68 with respect to the wearer. Hip support 60 comprises an anterior connector 62, such as a buckle or strap or other fastener for fastening across the anterior of the wearer's waist. The hip support 60 additionally comprises a posterior connector 65, for connection to or across the posterior side of the wearer or garment. In the illustrated embodiment, posterior connector 65 is adjustably connected to a posterior strap 66. The posterior strap 66 may be configured to extend across the posterior of the wearer and to connect to a right side resistance unit 58, such that the hip support 60 is connected to both the right and left resistance units 58, encircling at least a portion and preferably all of the waist of the wearer in the as worn configuration.

The axis of rotation of the resistance element 68 is displaced inferiorly from the wearer's waist line along an inferior-superior axis 70 by at least about 2 or 3 or 4 or more inches. The posterior connector 65 extends along a longitudinal axis 72 which intersects with the axis 70 at an angle 74. The angle 74 causes the axis 72 to deviate from perpendicular to axis 70 by at least about 2°, and in some embodiments at least about 3° or 5° or more.

The posterior strap 66 may be adjustably connected to the posterior connector 65. In one implementation, one of the posterior strap 66 or connector 65 is provided with a plurality of apertures 76. The other is provided with at least one post 78. In an alternate embodiment, the two components may be secured by Velcro, or a buckle. In a further implementation, the strap 66 is slidably engaged with the posterior connector 65. This may be accomplished, for example, by providing a first raised rail 80 and a second raised rail 82 defining a recess 84 there between within which the posterior strap 66 can slide. Posterior connector 65 may be retained within the recess 84 such as by a flange on one or both of the rails 80 and 82, or by connecting the rails 80 and 82 to form an enclosure for receiving posterior strap 66. Enclosure may be formed by a plastic restraint, integrally formed with the posterior connector 65, or by a fabric enclosure. Alternatively, the posterior strap 66 comprises a fabric or elastic such as a belt or waist band on a pant.

The components of the hip support 60 may comprise polymeric sheet or membranes, various technical fabrics as has been described elsewhere herein, or combinations of the two, in order to optimize comfort, fit and structural integrity of the connection of the hip support 62 to the wearer. Any portions or all of the hip support may be distinct structures attached to or worn over the top or under the garment, or may be structural fabric and components woven or sewn into the garment.

Preferably, the hip support 60 is constructed largely in fabric, such that it has sufficient flexibility and durability to be comfortable, durable, and able to withstand normal washing and drying cycles. In a preferred embodiment, the first lever 62 is provided with a docking station for removably receiving and engaging the resistance element 68 and second lever 64.

Thus, referring to FIG. 12, a modular detachable femoral resistance unit 67 may be provided. The femoral unit 67 may comprise one or both of the second lever 64 and the resistance element 68. In the illustrated embodiment, resistance element 68 is bonded or otherwise secured to or integrally molded with the second lever arm 64 to provide an integral modular femoral resistance unit 67.

Figure 15:
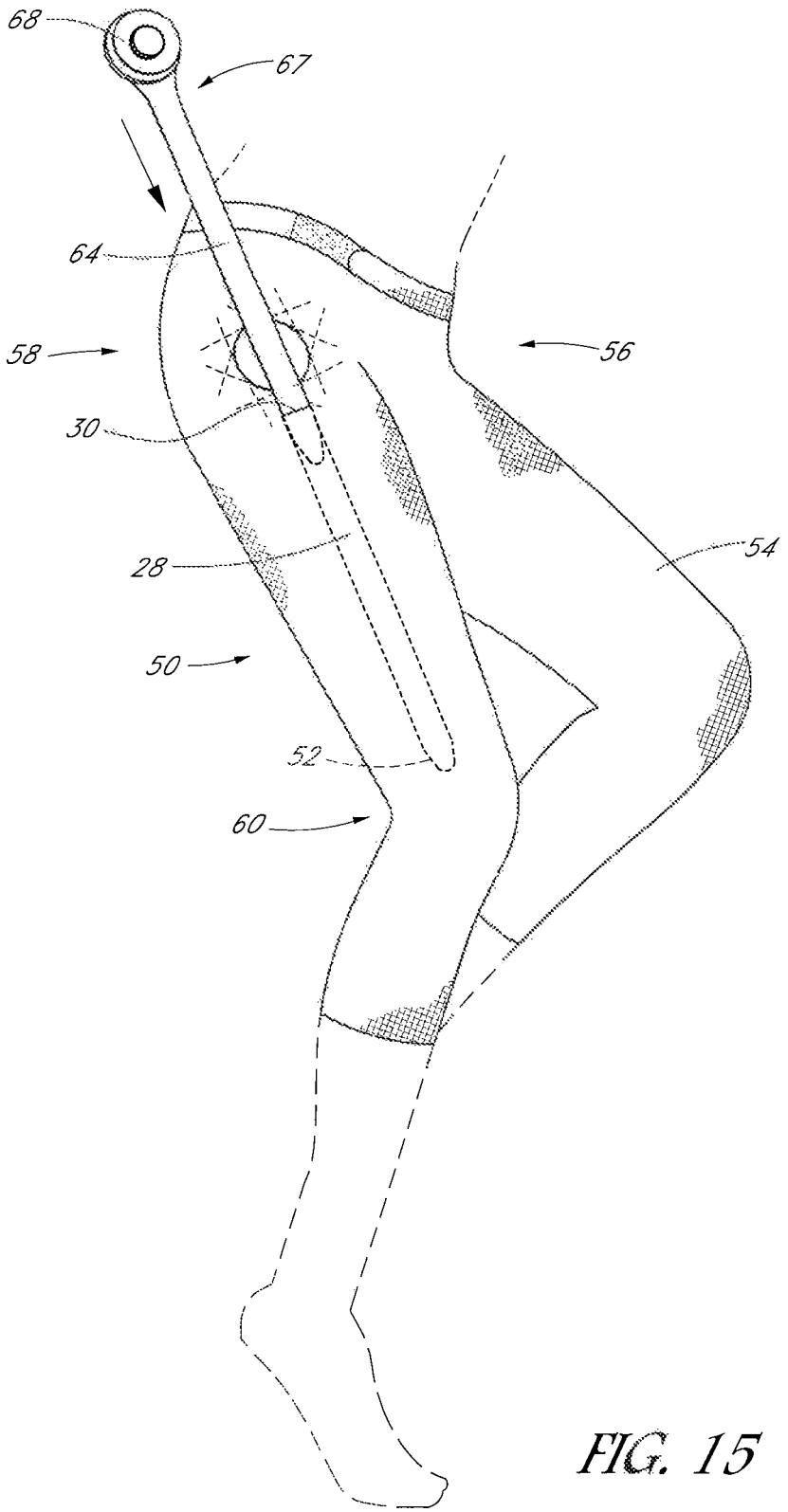
FIG. 15 is a garment as in FIG. 13, with a removable modular resistance unit partially assembled with the garment.
Figure 16:
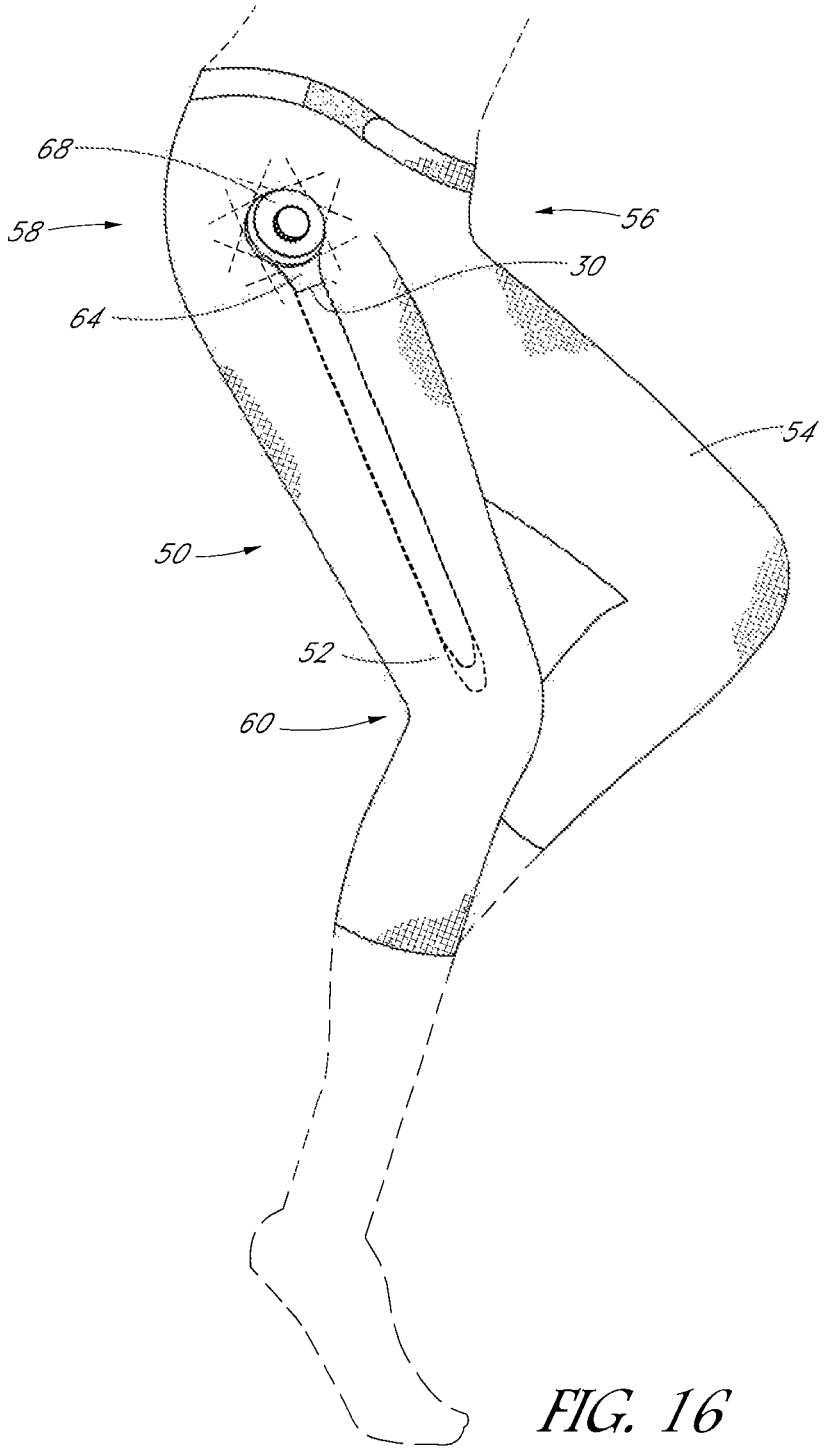
FIG. 16 is a garment as in FIG. 15, with the removable modular resistance unit fully installed, and engaged with the docking station.

Referring to FIGS. 15 and 16, this configuration allows the wearer to put the garment on with just any of the hip docking platforms disclosed herein secured thereto. Once the garment is on, the second lever 64 may be inserted within the femoral attachment element such as pocket 28 running down the lateral side of the leg or otherwise removably secured to the garment or the wearer's leg. The resistance element 68 is then aligned with the docking platform on first lever 62, seated and coupled thereto. This may be accomplished by advancing a first connector such as the aperture on resistance element 68 over a second, complementary connector such as the post on first lever 62 to achieve rotational engagement, and locking the resistance element 68 into place using any of a variety of quick lock or release features. These include interference (snap) fit, or any of a variety of twist connectors, locking pins or levers or others known in the art.

The modular femoral resistance unit 67 may be uncoupled from the docking station such as by manipulating the quick release control, and removed from the garment to permit removing the garment from the wearer, and or placing the garment in the wash. In addition, a wearer may be provided with a plurality of matched pairs of modular femoral resistance units, each pair having matched resistance elements 68 with a different level of resistance from another pair. This modularity enables the wearer to select the desired level of resistance depending upon a given use environment, as well as to facilitate washing, and optimizing the useful life of whichever components of the detachable component resistance toning system have the greatest useful life. Additional details of suitable resistance elements are disclosed in US 2015/0190669, previously incorporated by reference herein.

The training garment preferably comprises at least one stretch panel for providing a snug fit and optional compression. The panel may exhibit stretch in at least a circumferential direction around the leg and waist such as a four way stretch denim. Stretch panels may comprise any of a variety of fabrics disclosed elsewhere herein. The panel may include woven textile having yarns at least partially formed from any of polyamide, polyester, nylon, spandex, wool, silk, or cotton materials, for example. More particularly, the yarns may be eighty percent polyamide and twenty percent spandex in some configurations. When formed from a combination of polyamide and spandex, for example, the stretch woven textile may exhibit at least thirty percent stretch prior to tensile failure, but may also exhibit at least fifty percent or at least eighty percent stretch prior to tensile failure. In some configurations of the garment, the stretch in stretch woven textile may equal or exceed one-hundred percent prior to tensile failure. The optimal amount of stretch will normally be the maximum stretch that still allows the wearer to move comfortably with minimal or no rotation of the docking platform relative to the wearer's hip under normal walking or running conditions, using a resistance unit that is rated for the particular garment. Too much stretch in a direction of force imposed by the resistance unit will allow the docking station to rotate thereby stretching the fabric rather than transfer all of the wearer's motion to the resistance unit.

Figure 17:
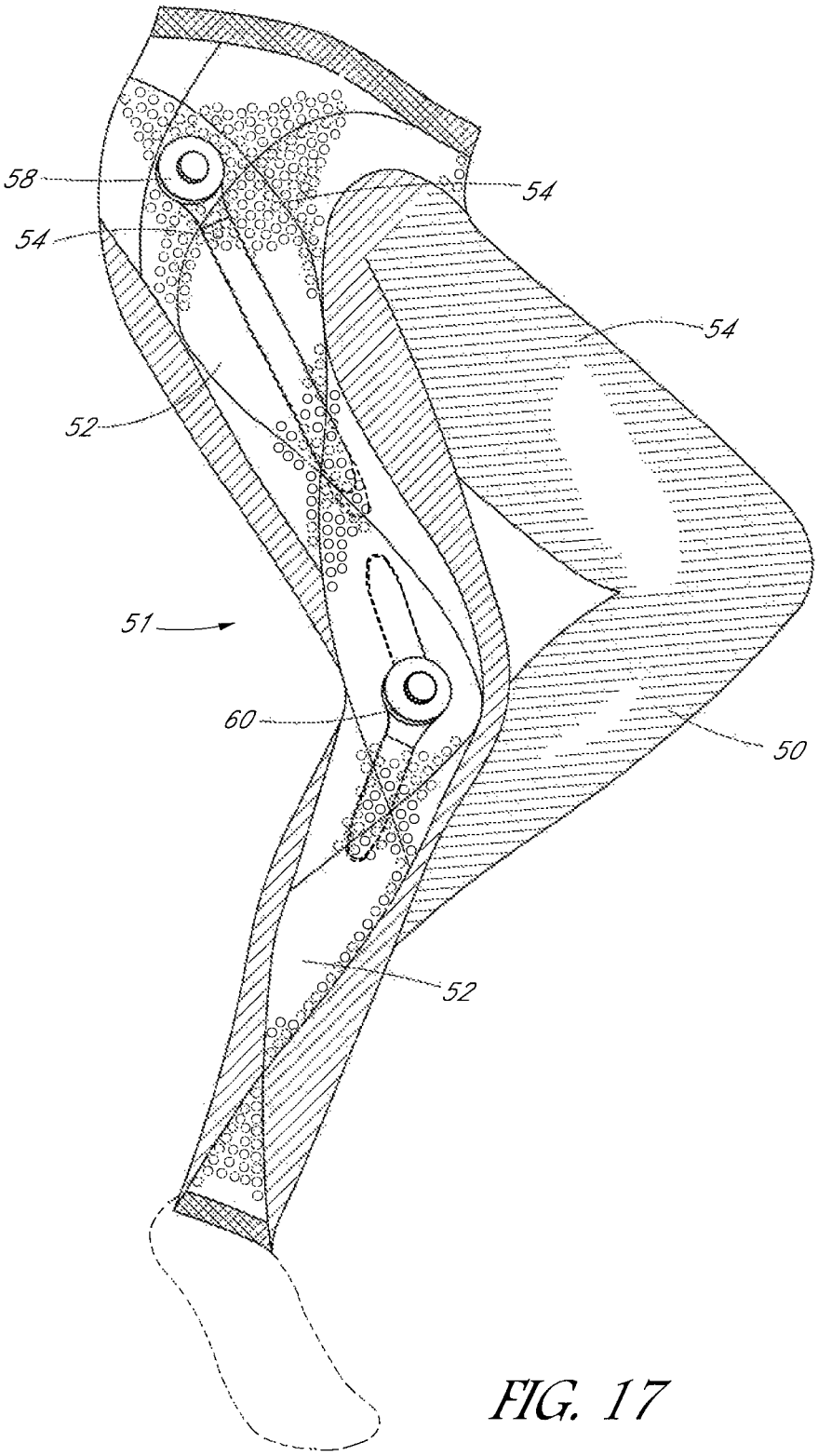
FIG. 17 is a side view of an athletic training garment incorporating hip and knee resistance units and technical fabric features of the present invention.

Referring to FIG. 17, at least one and in some implementations at least two or three or more technical fabric support panels 52 are provided on each of the right and left legs, to facilitate force transfer between the wearer and the hip resistance unit 58 and, when present, the knee resistance unit 60. The technical support panel 52 may be provided with at least one and normally a plurality of reinforcement strands 54 extending along a pattern to facilitate force transfer and maintaining fit of the garment throughout the range of motion in opposition to the resistance provided by the resistance unit. The technical fabric support panel 52 may be positioned over the entire height of the garment (as illustrated) or may be localized in the vicinity of the resistance units.

Yarns extending along a non-stretch or low stretch axis within non-stretch woven textile panel may be at least partially formed from any of polyamide, polyester, nylon, spandex, wool, silk, cotton or other high tensile strength strands disclosed herein. Depending upon the materials selected for the yarns, non-stretch woven textile may exhibit less than ten percent stretch prior to tensile failure, but may also exhibit less than five percent stretch or less than three percent stretch at least along the non-stretch axis prior to tensile failure.

A plurality of different panels of each of stretch woven or non-woven textile and non-stretch woven textile may be joined to form garment 51. That is, garment 51 may have various seams that are stitched or glued, for example, to join the various elements of stretch textile and non-stretch textile together. Edges of the various elements of stretch textile and non-stretch textile may be folded inward and secured with additional seams to limit fraying and impart a finished aspect to the garment. The garment 51 may be provided with one or more zippers, hook and loop fasteners or other releasable fasteners disclosed herein, such as one extending the full or partial length of one or both legs, to facilitate getting into and out of the garment. One or more non-stretch panels may be removably secured to the garment using a zipper or equivalent structure, hook and loop sections or otherwise. This enables the garment to be pulled on in a relatively stretchable mode. Following proper positioning of the garment on the wearer, force transfer features such as one or more low stretch features such as in the form of straps or panels can be secured to or tightened on the garment to reduce the stretch along the axes which will experience the most tensile force from the resistance units duriln motion of the wearer.

In general, the low stretch axis will be aligned in the anterior-posterior direction, or at least have a vector resolution component in the anterior posterior direction particularly for the femoral lever. Generally the low stretch axis will be within about 45 degrees up or 45 degrees down of horizontal, with the garment in the normal standing (vertical) orientation. The non stretch axis of the fabric at the hip will be oriented to resist rotation of the docking station, and thus will be oriented differently depending upon the presence or absence of an elongate, structural lever arm. For example, in an implementation having a superior lever, the non-stretch axis may be primarily oriented in the anterior posterior direction. In the absence of a superior lever, the nonstretch axis will be oriented to resist rotation of the connector, such as approximately at a tangent to a circle which is concentric about the connector. This may be accomplished through a variety of techniques, including circular weaving or knitting as is discussed elsewhere herein.

Stretch panels may be formed in the configuration of straps, having a length that exceeds the width, and constructed similar to the watersport waist band of U.S. Pat. No. 7,849,518 or U.S. Pat. No. 8,555,415, which are hereby incorporated by reference in their entireties herein. The longitudinal axis of the strap may extend circumferentially around the waist or leg above and or below each resistance unit to cooperate with the lever or other force transfer structure to shield the stretch fabric from tensile force. Alternatively, if less constriction on fit is desired, the axis of the strap may be angled up or down with respect to horizontal to extend in a spiral path which extends at least about 20%, often at least about 50% and in some embodiments at least about 75% or 100% or more of the circumference of the wearer's leg or waist. See FIGS. 6A-8 of US 2015/0190669 which can illustrate a non-stretch or low-stretch strap configuration or elastic straps which may be embedded within or over a multilayer stretch fabric panel garment. The garments of the present invention can also include elastic bands in the configurations illustrated in U.S. patent application Ser. No. 14/694,900 to Yao, published as US 2015/0306441, the entirety of which is hereby incorporated by reference herein.

Resistance generated by elastic stretch generally increases linearly as a function of elongation, assuming efficient force transfer between the wearer and the garment. Thus, at the beginning of a range of motion the resistance is relatively low, and at the end of the range of motion the resistance may be quite high. A combination of the (constant resistance at constant rotational velocity) resistance elements disclosed herein with an elastic restraint can have the effect of flattening out the change in resistance across the range of motion curve otherwise experienced by a purely elastic system. This is because the front end of the range of motion will be subject to a resistance imposed by the resistance unit. Supplemental resistance provided by the elastic band is thus additive to the resistance provided by the resistance element.

In a simple construction, a resistance band can be provided on the garment to resist forward swing at the hip or other joint, such as a panel extending generally vertically along the posterior of the garment. Alternatively or in addition, a resistance element may be provided to resist rearward swing at the hip or other joint such as a resistance element on the anterior side of the garment.

Figure 18:
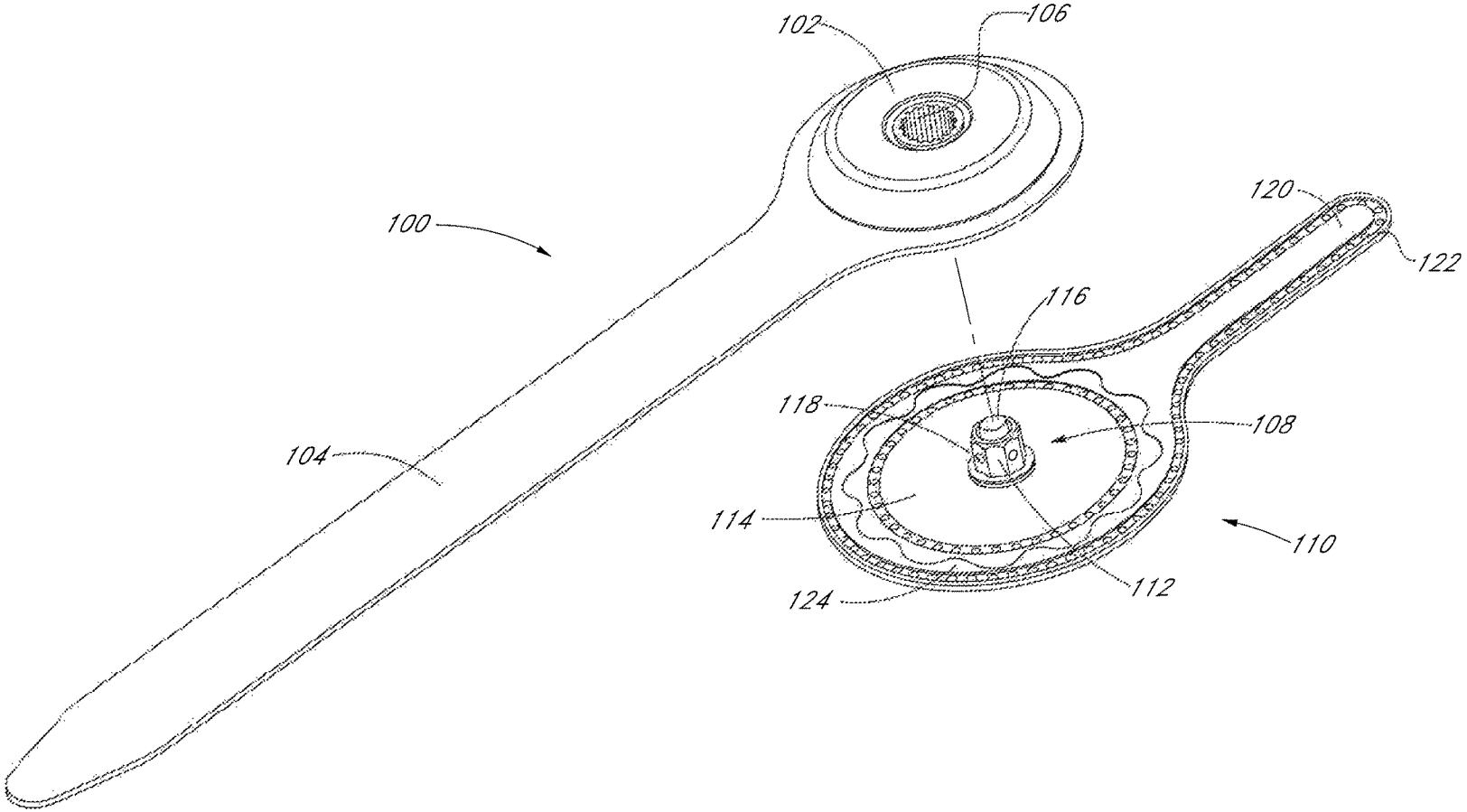
FIG. 18 is an exploded perspective view of a first lever having a resistance unit thereon, and a docking platform having a second lever.

Referring to FIG. 18, there is illustrated an exploded perspective view of a first lever having a resistance unit thereon, and a complementary docking platform having a second lever. The resistance unit 100 comprises a resistance element 102 and a femoral lever 104. The resistance element 102 comprises a connector 106, which, in the illustrated embodiment, comprises an aperture.

The aperture is configured to receive a complimentary connector 108 such as a post 112 on the docking platform 110. The post 112 comprises at least one axially extending slot, flat side or other key to provide rotational interlock with a complementary surface structure on the connector 106. In the illustrated embodiment, post 112 comprises a polygon, such as a hexagon or octagon. Alternatively, the post 112 may have a cylindrical configuration and the complementary aperture comprises the aperture through a spring clutch on the resistance unit 100. A control such as a lever, slider switch or button may be carried by the housing of resistance element 102 to change the inside diameter of the aperture of the spring clutch as is understood in the art. The relative location of the complementary connectors can be reversed between the docking platform 110 and the resistance element 102 depending upon the desired product design.

Connector 108 is carried by a docking platform 110, which includes a base plate 114 secured to the post 112. Post 112 is provided with a quick release button 116, depression of which allows a plurality of interference locks such as a ball or post 118 to retract radially inwardly to disengage a complementary recess within the connector 106. Preferably, the connector 108 is not able to rotate with respect to plate 114.

In use, movement of leg throughout a stride carries the femoral lever 104 through an arcuate path generally within the anterior posterior plane, which pivots about the axis of rotation extending through connector 108. The resistance unit transfers more or less rotational force to the post 112 depending upon the resistance rating of the resistance element 102. The docking platform 110 is configured to distribute rotational force transferred by the post 112 to a larger surface area of the underlying garment or to a point of greater distance from the axis of rotation to prevent the post 112 from rotating in a manner that twists or otherwise deforms the fabric of the compression garment.

Since the force applied to the garment at a given point is equal to the torque applied by the resistance element 102 during a stride times the radius or distance from the center of rotation to that point, a larger diameter docking platform 110 would more effectively distribute rotational force to the fabric without distortion. However, anatomical constraints due to the dynamic three dimensional configuration of the wearer and garment in the vicinity of the hip limit the diameter of the docking platform 110. Accordingly, one or more levers may extend radially outwardly or at a tangent or other angle to a circle concentric about the post 112 such as the best fit circle about the periphery of the docking platform 110.

In the illustrated embodiment, a lever 120 extends outwardly from the post 112 and docking platform 110 to increase the effective distance (radius) from the axis of rotation and better distribute rotational force. Lever 120 may extend at least about one or 2 inches from the periphery of the plate 114 or from the post 112 in an implementation where the plate is the same diameter as and/or an integral portion of the post 112 (effectively no distinct plate).

In some implementations, the lever 120 extends at least about four or 5 inches or more from the post 112. If the lever 120 is configured to reside on a coronal plane (approximately straight up and down) as illustrated, for example, in FIG. 1, extending upwardly when the wearer is in a standing position, the lever will typically be no more than about 6 inches, but at least about 5 inches or 4 inches from the axis of rotation, depending upon the distance between the rotational axis of the hip and the top of the wearer's belt line. The superior lever 120 may alternatively extend circumferentially part way or all the way around the wearer's leg, or in a spiral or angled orientation inclining upwardly or downwardly from the post 112.

The docking platform 110 in the illustrated the embodiment is intended to be permanently secured to the garment. For this purpose, a plurality of apertures 122 may be provided at least around the periphery of the superior lever 120 and an interface 124 for connecting to the plate 114. In the illustrated embodiment, the interface 124 comprises a ring which may be integrally formed with superior lever 120. The ring includes an aperture for receiving the plate 114. To minimize the risk of rotation of the plate 114 within the ring, the inner diameter of the ring may have one or more rotational locking keys such as flat surfaces or radially facing projections or recesses such as the illustrated sinusoidal periphery, which interlocks with a complementary exterior circumference of the plate 114. Alternatively, the lever 120, plate 114 and optionally connector 108 may be integrally formed such as through molding or machining techniques known in the art.

At least one lever 120 and optionally two or more levers may be mechanically linked to the post 112, and the length of the lever or levers can be optimized based upon the stretch of the fabric of the underlying garment, along with the rated torque for the resistance unit 100 intended to be used with that garment.

Figure 19:
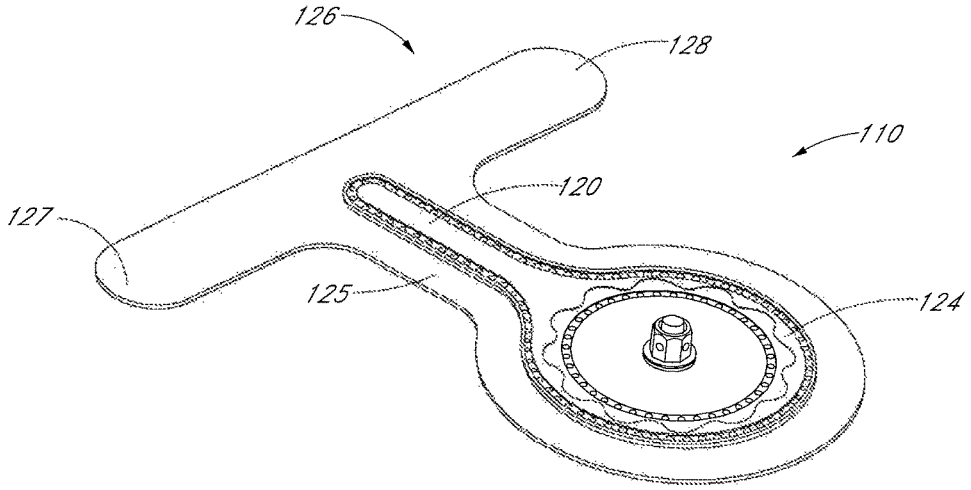
FIG. 19 is a perspective view of a docking platform having a second lever, attached to a force transfer layer.

FIG. 19 illustrates a docking platform 110 assembly as in FIG. 18, with the addition of a force transfer layer 125. As has been discussed, force transfer layer 125 is preferably a flexible fabric, molded mesh, metal mesh or other layer that provides a force transition between the superior lever 120 and the fabric of the garment. In the illustrated embodiment, force transfer layer 125 extends outwardly beyond the periphery of the interface 124. This aspect of force transfer layer may be omitted. The most effective force transfer occurs at the superior end of superior lever 120, which is the greatest radius from the center of rotation. Thus, the force transfer layer 125 is preferably provided with a transverse band 126 which comprises or is attached to the waistband of the garment. Transverse band 126 may be provided with both a left strap 127 and right strap 128 which may each extend at least about 2 inches, and preferably at least about 4 inches or 6 inches or more from the midline of the superior lever 120. The transverse band 126 on the left resistance assembly may be connected with the transverse band 126 on a right resistance assembly either on the posterior side or the anterior side or both, of the wearer. In this configuration, the anterior connection between the left side and right side transverse bands is preferably provided with a releasable connector such as a buckle, or complementary hook and loop fastening straps for adjustable attachment to the wearer. The transverse band 126 may comprise a low stretch fabric or other material having sufficient structural integrity under tension that it resists movement of the superior lever 120 about the axis of rotation.

In one implementation of the invention, applicable to any of the embodiments described herein, the docking plate 114 is mounted with no direct attachment to the underlying garment. This allows the docking plate to float in response to anatomical movement, although not rotate relative to the axis of the post 112. The superior lever 120 will be securely attached to the garment, such as by transverse band 126 or other force transfer layer or attachment technique disclosed herein. Attachment may be constrained to an attachment zone within the upper 75%, upper 50%, upper 25% or less of the length of the superior lever, measured from the rotational axis. The attachment zone may extend inferiorly to the upper limit of the plate 114 or as far inferiorly as the level of the post 112. The remainder of the docking platform 110 below the attachment zone remains floating with respect to the garment. The upper lever 120 may be integrated into the garment or covered by a stretch panel and both the front and back sides remain unattached to the garment or cover layer outside of the attachment zone.

Figure 20:
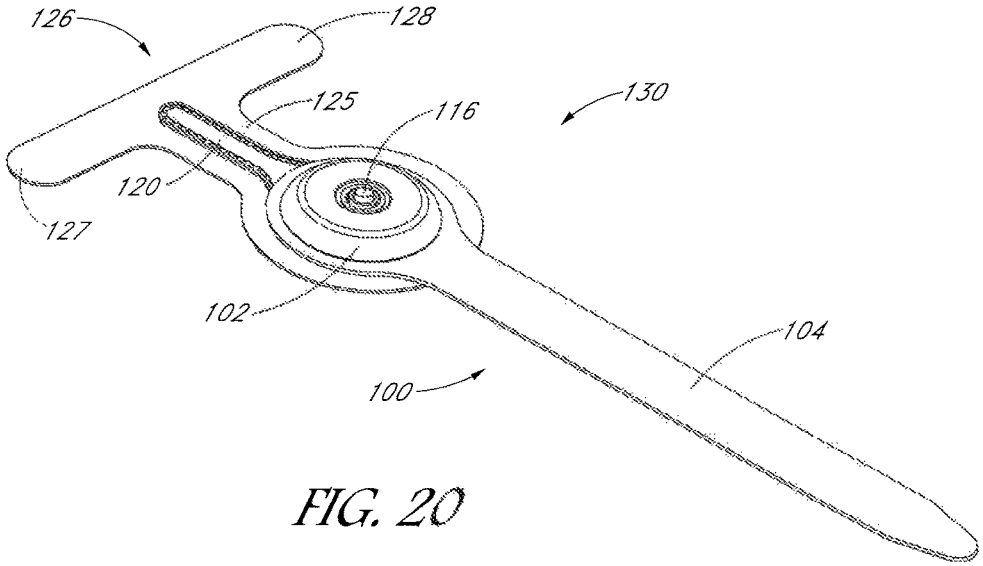
FIG. 20 is a perspective view of a resistance subassembly, including an upper lever attached to a force transfer layer, and a lower lever having a resistance unit pivotably mounted on the docking station.

Referring to FIG. 20, there is illustrated a perspective view of a complete resistant subassembly 130, including an upper lever 120 attached to a force transfer layer 125 and a lower resistance unit 100 pivotably mounted on the docking station.

The modular resistance unit 100 has generally been illustrated as having a resistance element 102 mounted on a femoral lever 104. It may in some circumstances be desirable to allow the resistance element 102 to be removed from the garment as a separate unit, leaving both of the upper and lower levers permanently or removably coupled to the garment.

Figure 21:
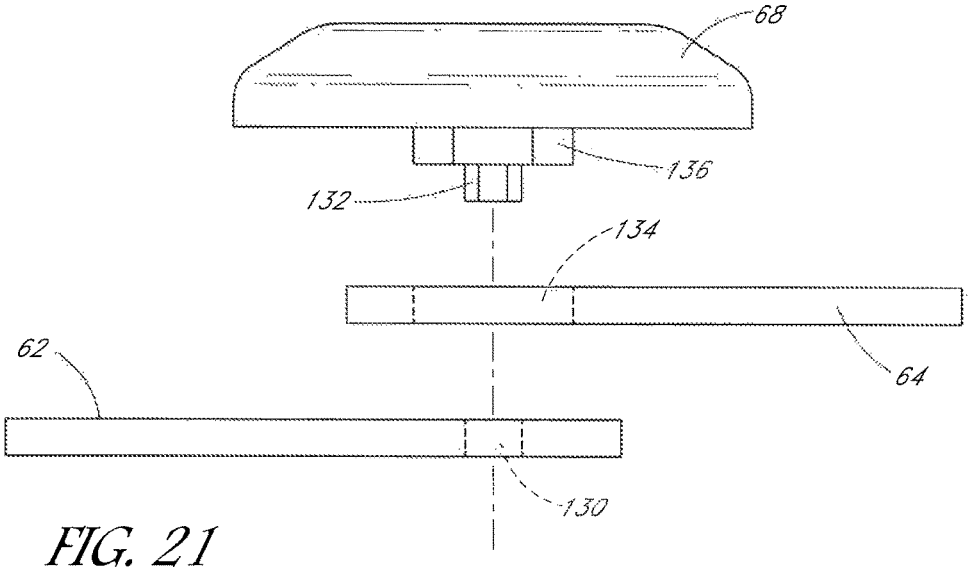
FIG. 21 is a side elevational view of first and second levers configured to receive a resistance unit having a compound post thereon.

Referring to FIG. 21, there is illustrated an exploded view of a first lever 62 having a first aperture 130. A second lever 64 is provided with a second aperture 134. Both levers 62 and 64 may be permanently carried by the garment. Alternatively, either or both of the levers 62 and 64 may be removably carried by the garment.

When mounted on the garment, the first aperture 130 and second aperture 134 are substantially coaxial. First aperture 130 is provided with a keyed cross-section such that it receives a first complementary projection 132 on resistance unit 68 so that rotation of first lever 62 will cause an equal rotation of first projection 132. Keyed projections and complementary apertures may comprise at least one flat side or spline, and in some embodiments comprise a polygon such as a hexagon or octagon or a greater number of rotational interlocking surface structures such as axially extending teeth on a gear and complementary axially extending grooves. At least 8 or 10 and depending upon construction materials at least 15 or 20 or more teeth and complementary grooves may be provided to increase the number of rotational alignments which will allow the resistance element to be mounted on the corresponding post.

The second aperture 134 is larger than the first aperture 130, and additionally comprises a keyed periphery so that it rotationally engages with a complementary second projection 136 carried by the resistance element 68.

The resistance element 68 is configured to provide resistance to relative motion of first projection 132 with respect to second projection 136. In this manner, the first lever 62 engages first projection 132 and second lever 64 engages second projection 136 so that rotation of first lever 62 with respect to second lever 64 about the axis of rotation is subject to the resistance provided by resistance element 68.

Figure 22:
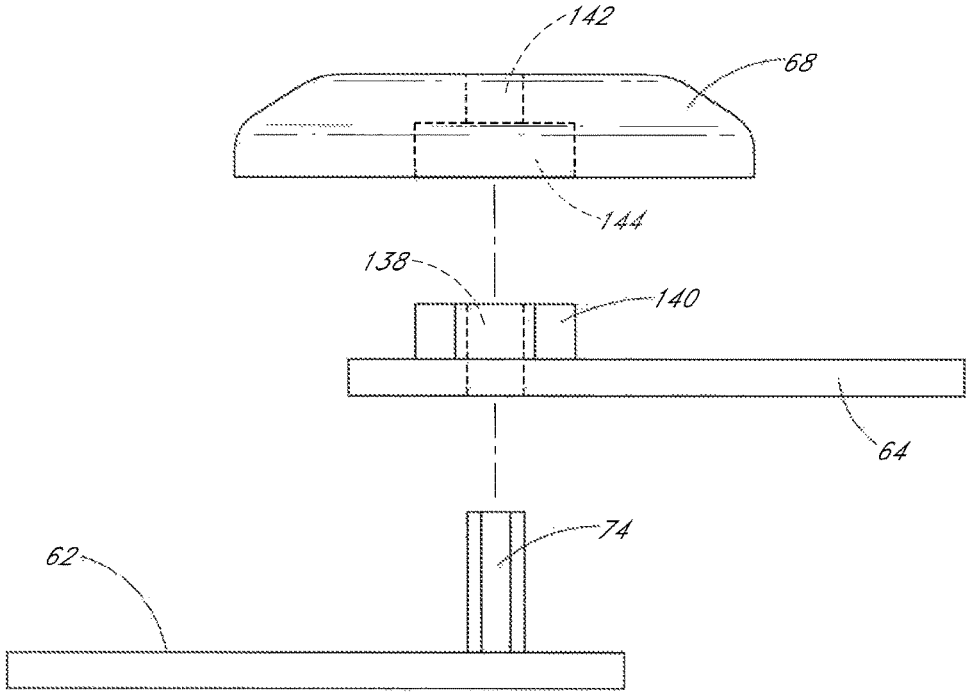
FIG. 22 is a side elevational view as in FIG. 21, of a first and second lever configured to receive a resistance unit having a compound aperture thereon.

FIG. 22 illustrates an inverse configuration, where the garment carries post 74, attached to first lever 62. The second lever 64 is provided with a keyed ring 140 having an interior passage 138 for receiving post 74. Post 74 is provided with a keyed surface, and the cross-sectional dimension of passage 138 is sufficiently large that post 74 can rotate freely therein. Keyed ring 140 has a keyed exterior surface.

Figure 23:
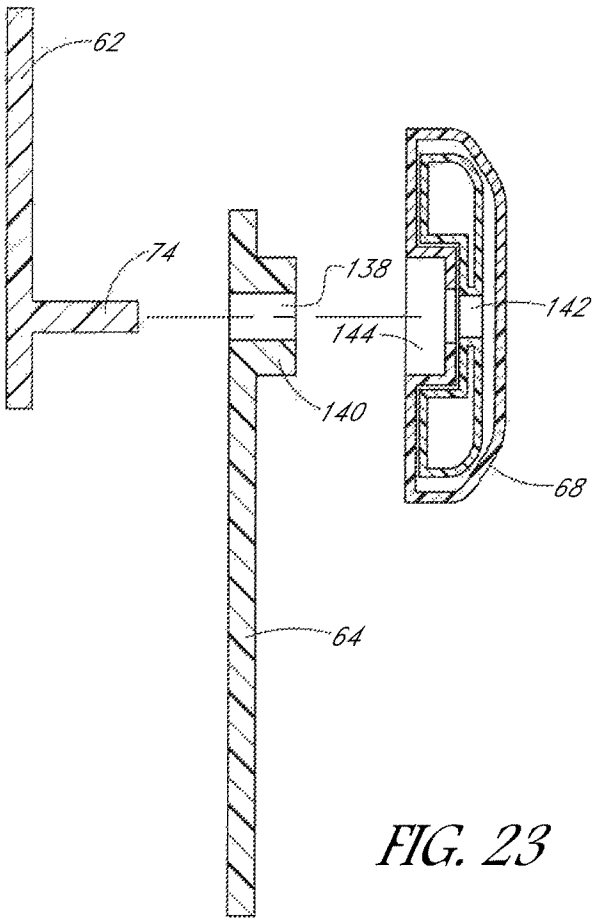
FIG. 23 is a cross-sectional view through the assembly of FIG. 22.

Post 74 extends through and beyond keyed ring 140 and is received within a first cavity 142 on the resistance element 68 and is rotationally locked therein. Keyed ring 140 is received within a complementary second cavity 144 and is rotationally locked therein. In one implementation of the invention, illustrated in FIG. 23, the keyed second cavity 144 is rotationally connected to the housing of the resistance element 68. Keyed post 74 is rotationally linked to an interior component of the resistance element 68 which rotates relative to the housing subject to the resistance provided by the resistance element.

Figure 24:
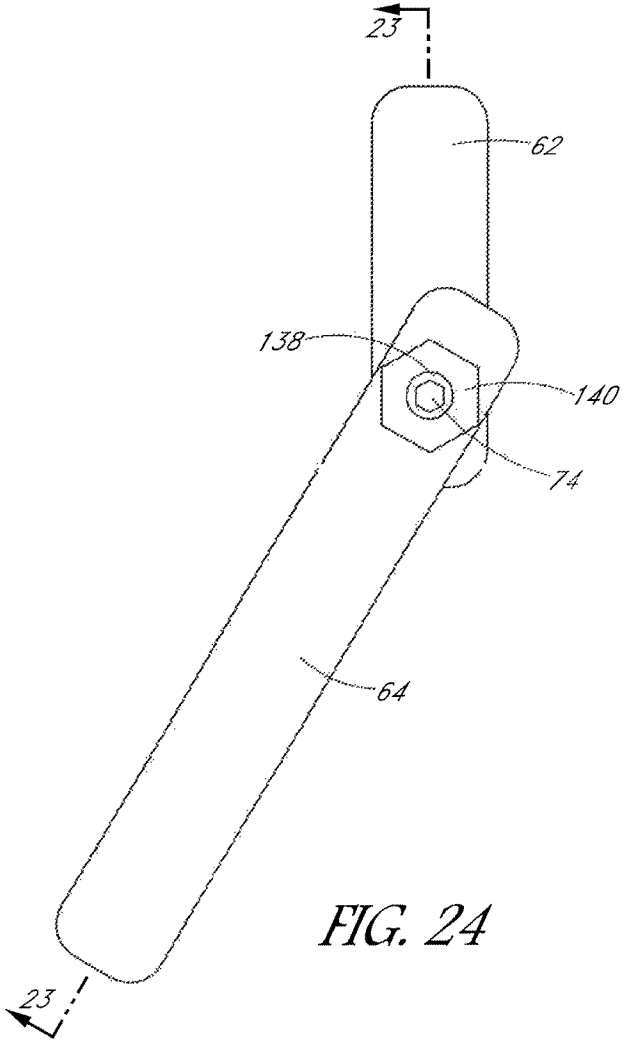
FIG. 24 is an elevational view of the embodiment of FIG. 22, assembled but without a resistance element.

FIG. 24 illustrates a plan view of the first and second levers with keyed ring 140 fully seated on post 74, and ready for attachment of the resistance element 68.

Figure 26:
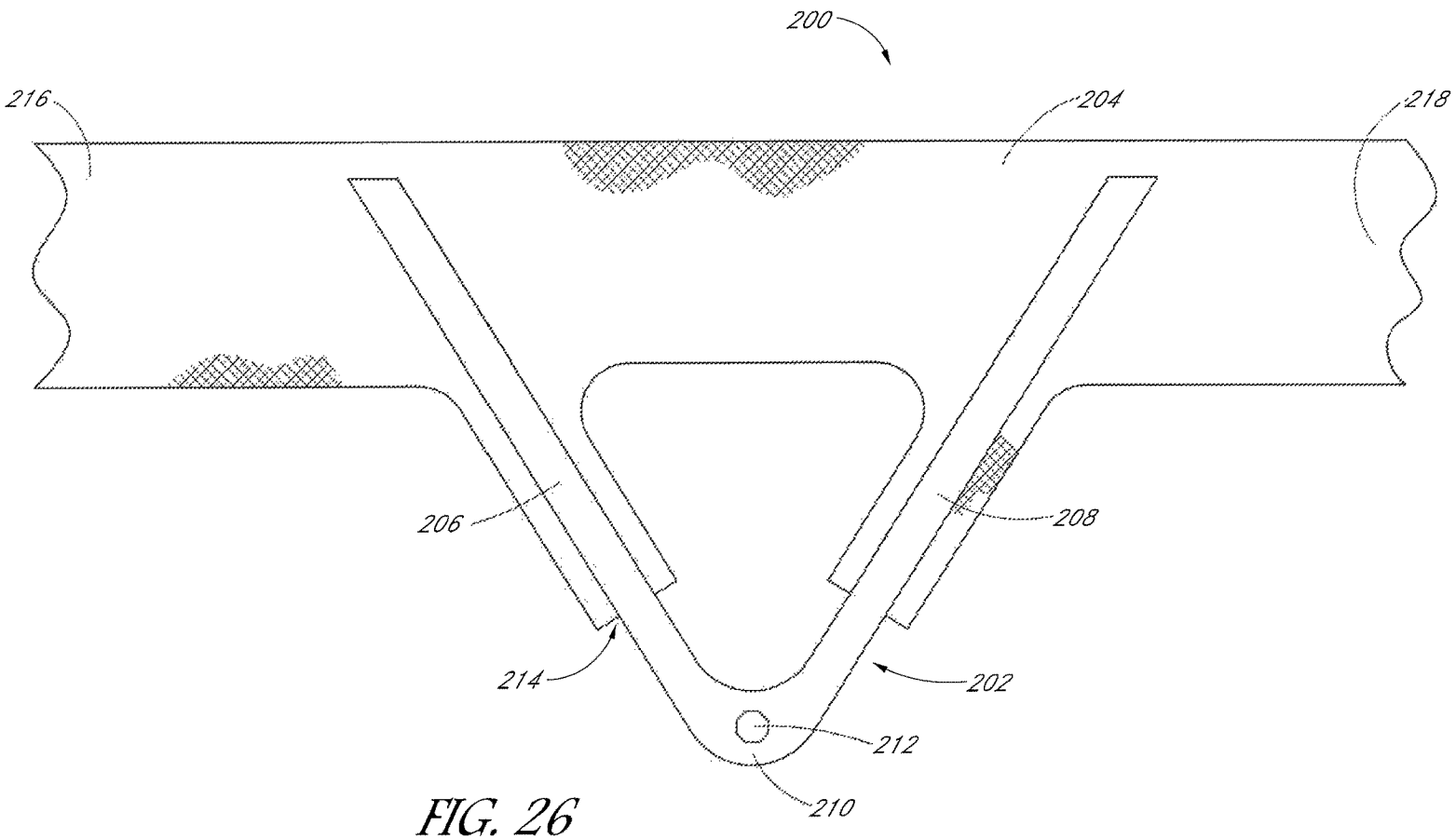
FIG. 26 is a side elevational view of a force transfer assembly have a "V" configuration.

Referring to FIG. 26, there is illustrated an alternative superior attachment assembly 200. The attachment assembly 200 comprises a lever 202 in the form of a "V", having at least a first strut 206 and a second strut 208. First strut 206 and second strut 208 are provided with a force transfer layer 204 as has been discussed.

First strut 206 and second strut 208 are joined at an apex 210, which is concave in an upward direction in the as worn orientation. Apex 210 and force transfer layer 204 are configured to place the apex 210 approximately in alignment with the axis of rotation of the wearer's hip or other joint. Apex 210 is provided with a connector 212, which may be an aperture or post as has been discussed.

Each of first strut 206 and second strut 208 have a length within the range of from about 3 inches to about 8 inches, depending upon garment design. Each strut may have a width within the range of about 0.25 inches and about 2 inches, typically between about 0.5 inches and 1.5 inches, depending upon garment design and the intended resistance rating. Three or four or more struts may be connected to apex 210, depending upon desired performance.

Force transfer layer 204 on a first side of the wearer may have extensions 216 and 218 which extend in a circumferential direction around the waist of the wearer. Extensions 216 and 218 may be integral with or connect with the extensions on the superior attachment assembly 200 on a second side of the wearer.

The force transfer layer 204 may extend along the length of the first strut 206 and second strut 208 to a transition 214. Above the transition 214, the lever 202 is securely attached to the underlying garment such as by way of the force transfer layer 204. Below transition 214, the lever 202 is unattached to the underlying garment, so that the apex 210 can float with respect to the underlying garment.

Figure 27:
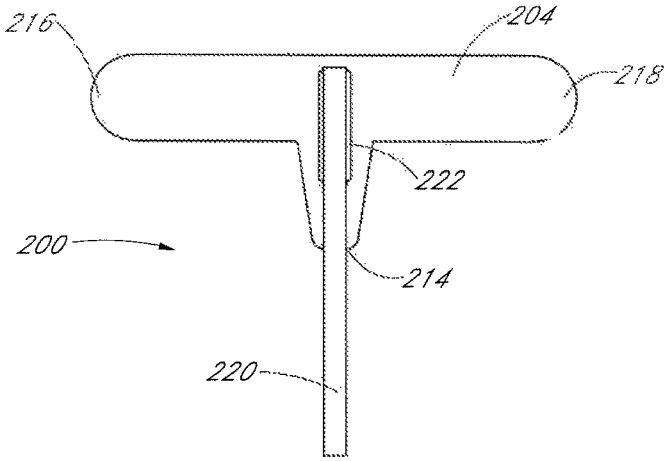
FIG. 27 is a side elevational view of a force transfer assembly having an adjustable docking station.
Figure 28:
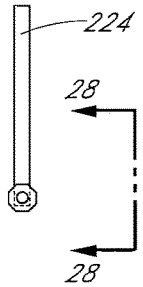
FIG. 28 is a detail view of the docking station of FIG. 27.
Figure 28:
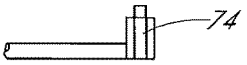
Figure 29:
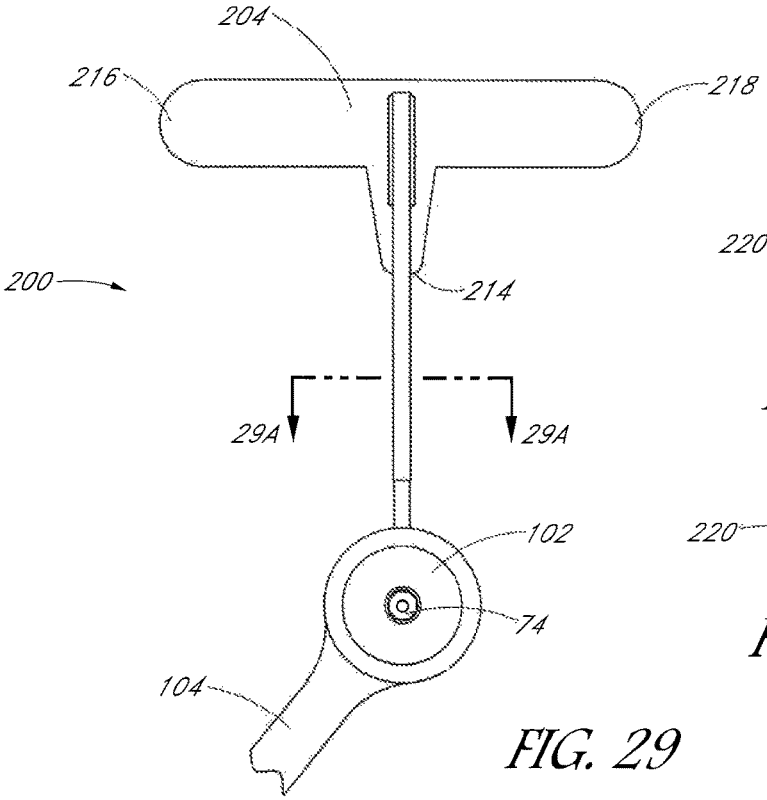
FIG. 29 is a side elevational view of the force transfer assembly of FIG. 27, having a resistance unit mounted thereon.
Figure 29A:
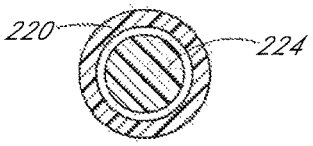
FIG. 29A is a cross section taken along the line 29 A-29 A in FIG. 28, of a dock support having two degrees of freedom.
Figure 29B:
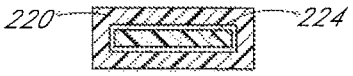
FIG. 29B is a cross section taken along the line 29 A-29 A in FIG. 28, of an alternative configuration restricted to one degree of freedom.

A superior attachment assembly 200 having multi axial adjustability is illustrated in FIG. 27. A tubular support 220 is securely bonded 222 to force transfer layer 204. Tubular support 220 is configured to axially slidably received a rod 224 telescopically therein. The orientation of the sleeve and rod may be reversed as will be apparent to those of skill in the art. Rod 224 carries a connector such as a post 74, for engaging any of the resistance units describe elsewhere herein. The rod 224 may optionally also carry a docking plate from which the post extends. As illustrated in FIG. 29, a resistance assembly may be mounted on the post 74.

In an implementation illustrated in FIG. 29 A, at least the tube 220 and optionally the rod 224 have a circular cross-section. In this implementation, the rod 224 can rotate within the tube 220, allowing the resistance unit 102 to tilt from side to side. This allows the resistance unit 102 to accommodate movement of the wearer. If side to side adjustability is not desired, the tubular support 220 and corresponding rod 224 may be configured in a non-circular cross-section such as rectangular as illustrated in FIG. 29 B.

If the rod 224 remains axially slidably carried within tubular support 220, the post 74 is permitted to float up or down relative to the force transfer layer 204 and or tubular support 220. This adjustability along a vertical axis allows the resistance unit 102 to float, and adapt to minor movements of the wearer and/or initial misalignment between the rotational axis of the resistance unit 102 and the rotational axis of the underlying joint. The range of float may be limited such as by providing opposing interference surfaces on the rod and sleeve, spaced apart by the desired float.

Single or double or more axes of adjustability may be provided in any of the embodiments disclosed herein. For example, the apex 210 of lever 202 illustrated in FIG. 26 may be provided with a vertically extending guide such as a tube, for axially and/or rotatably receiving a rod 224 carrying a connector such as a post 74. The post 74 may be directly coupled to the rod 224, with or without a docking plate as has been discussed elsewhere herein.

Figure 30:
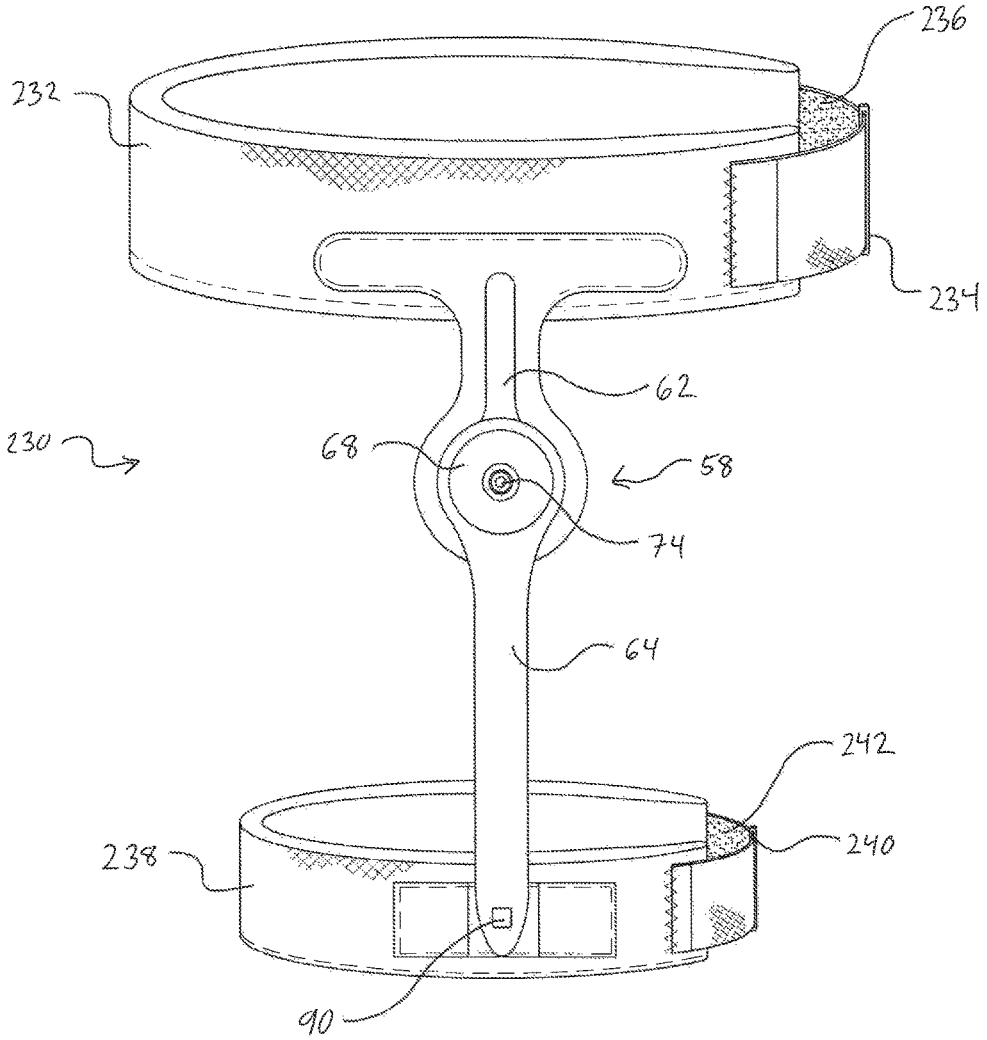
FIG. 30 is a side elevational view of a resistance harness in accordance with the present invention.

Referring to FIG. 30, there is illustrated a training harness in accordance with the present invention. The training harness may be configured for rapid attachment to the outside of a pair of pants or other athletic gear, or beneath clothing such as street clothing.

The harness 230 comprises a waistband 232, for removable attachment around the waist of the wearer. Waistband 232 may comprise a strap having foam padding. Waistband 232 is provided with an attachment strap 236 such as a Velcro strap attached to the waistband 232. An attachment structure such as a belt loop (buckle) 234 may be provided, for attachment using Velcro strap. This construction enables a single device to be appropriately sized for any of a wide variety of wearers.

The harness 230 additionally comprises attachment structures for receiving a resistance unit 58. The resistance unit 58 in general includes a connector for receiving a resistance element 68, along with a first superior lever 62 and a second inferior lever 64 as has been discussed.

An inferior connector 90 connects the second lever 64 to a leg band 238. Leg band 238 is a flexible, padded band configured to wrap around and secure to the leg of the wearer. For this purpose, an attachment such as buckle loop 240 may be provided to cooperate with a strap 242 such as an elastic strap with Velcro attachment. The strap may be pulled through the belt loop 240 and secured to itself, to wrap the leg band 238 firmly around the leg of the wearer. One or two or three or more leg bands 238 maybe provided, depending upon the intended load to be applied.

The harness 230 may be constructed of flexible, breathable lightweight materials which have relatively low stretch compared to some of the compression garments disclosed elsewhere herein. As such, the harness 230 may support resistance units having a much higher resistance to rotation, such as at least about 20 inch pounds, at least about 30 or 40 or 50 or more inch pounds of torque. As with other embodiments disclosed herein, the harness 230 is preferably bilaterally symmetrical although only a single side has been shown to simplify the drawing.

Although disclosed primarily in the context of lower body garments, any of the resistance elements and attachment fabrics and structures disclosed herein can be adopted for use for any other motion segment on the body, including the shoulder, elbow, wrist, neck, abdomen (core) and various other motion segments of the upper body. Any of the various resistance elements and attachment structures disclosed herein can be interchanged with any other, depending upon the desired performance. In addition, the present invention has been primarily disclosed as coupled to a type of garment resembling a complete article of clothing. However any of the resistance systems disclosed herein may be carried by any of a variety of braces, wearable clothing subassemblies, straps, cuffs or other wearable support construct that is sufficient to mechanically couple one or more resistance elements to the body and achieve the force transfer described herein, that may be worn over or under conventional clothing.

What is claimed is:

1. A technical garment, having a waist portion with right and left lateral sides, and right and left legs;

a first connector carried by fabric on the right lateral side and a second connector carried by fabric on the left lateral side of the garment;

wherein the first and second connectors are rotatable with respect to the waist portion of the garment in an as worn configuration by stretching the fabric in a twisting pattern concentrically about an axis of rotation through an angle of no more than about 10 degrees upon application of a rotational torque of about 8 inch pounds to the first and second connector.

2. A technical garment as in claim 1, wherein the first and second connectors are rotatable with respect to the waist portion of the garment in an as worn configuration through an angle of no more than about 10 degrees upon application of a rotational torque of about 12 inch pounds to the first and second connector.

3. A technical garment as in claim 1, wherein the first and second connectors are rotatable with respect to the waist portion of the garment in an as worn configuration through an angle of no more than about 10 degrees upon application of a rotational torque of about 14 inch pounds to the first and second connector.

4. A technical garment as in claim 1, wherein the first and second connectors are rotatable with respect to the waist portion of the garment in an as worn configuration through an angle of no more than about 3 degrees upon application of a rotational torque of about 12 inch pounds to the first and second connector.

5. A technical garment as in claim 1, wherein at least one of the first and second connectors comprises a post.

6. A technical garment as in claim 5, wherein the post comprises at least one spline.

7. A technical garment as in claim 1, wherein at least one of the first and second connectors is carried by a docking platform.

8. A technical garment as in claim 7, wherein the docking platform is attached to the garment by a force transfer layer.

9. A technical garment as in claim 8, wherein the docking platform is attached to the force transfer layer by stitching.

10. A technical garment as in claim 8, wherein the docking platform is attached to the force transfer layer by adhesive.

11. A technical garment as in claim 8, wherein the force transfer layer is attached to the garment by stitching.

12. A technical garment as in claim 8, wherein the force transfer layer is attached to the garment by adhesive.

13. A technical garment as in claim 1, comprising at least one panel of compression fabric.

14. A technical garment as in claim 13, wherein the compression fabric exhibits at least 30% stretch prior to tensile failure.

15. A technical garment as in claim 13, wherein the compression fabric exhibits at least 50% stretch prior to tensile failure.

16. A technical garment as in claim 15, wherein the compression fabric exhibits at least 80% stretch prior to tensile failure.

17. A technical garment as in claim 1, wherein at least the waist portion comprises a compression fabric.

18. A technical garment as in claim 1, further comprising a third connector carried by the right leg and a fourth connector carried by the left leg for cooperating with the first and second connectors to receive a right and left resistance unit.

19. A technical garment as in claim 18, wherein the third and fourth connectors comprise openings on the right and left leg of the garment for receiving femoral levers on the right and left resistance units.

20. A technical garment as in claim 1, wherein the first connector is secured to the fabric by a first docking platform, and the second connector is secured to the fabric by a second docking platform.

21. A technical garment as in claim 20, further comprising a lever extending from each of the first and second docking platform and attached to the waist portion of the garment.

22. A technical garment as in claim 21, wherein the lever extends superiorly within 90 degrees in an anterior posterior direction from the coronal plane.

23. A technical garment as in claim 22, wherein the lever extends superiorly within 45 degrees in an anterior posterior direction from the coronal plane.

24. A technical garment as in claim 23, wherein the lever extends superiorly and resides on the coronal plane.

25. A technical garment as in claim 24, wherein the lever comprises a longitudinal axis and a transverse section which extends in a circumferential direction with respect to the waist portion.

26. A technical garment as in claim 1, wherein at least one of the first and second connectors comprises an aperture.

* * * * *